US011435066B2

(12) United States Patent
Danesh

(10) Patent No.: US 11,435,066 B2
(45) **Date of Patent: *Sep. 6, 2022**

(54) OUTER CASING FOR A RECESSED LIGHTING FIXTURE

(71) Applicant: DMF, Inc., Carson, CA (US)

(72) Inventor: Michael D. Danesh, Carson, CA (US)

(73) Assignee: DMF, Inc., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/473,934

(22) Filed: Sep. 13, 2021

(65) Prior Publication Data

US 2022/0018525 A1 Jan. 20, 2022

Related U.S. Application Data

(63) Continuation of application No. 16/779,824, filed on Feb. 3, 2020, now Pat. No. 11,118,768, which is a (Continued)

(51) Int. Cl.
*F21V 21/14* (2006.01)
*F21S 8/02* (2006.01)

(Continued)

(52) U.S. Cl.
CPC ..... *F21V 21/14* (2013.01); *F21S 8/024* (2013.01); *F21S 8/026* (2013.01); *F21V 21/04* (2013.01);

(Continued)

(58) Field of Classification Search
CPC ..... F21V 21/14; F21S 8/024; F21S 8/026
See application file for complete search history.

(56) References Cited

U.S. PATENT DOCUMENTS 1,133,535 A 3/1915 Cain et al.
1,471,340 A 10/1923 Knight (Continued)

FOREIGN PATENT DOCUMENTS

CA 2243934 C 6/2002
CA 2502637 A1 9/2005

(Continued)

OTHER PUBLICATIONS

U.S. Appl. No. 14/183,424, filed Feb. 18, 2014, Danesh.

(Continued)

*Primary Examiner* — Bryon T Gyllstrom
*Assistant Examiner* — Christopher E Dunay
(74) *Attorney, Agent, or Firm* — Smith Baluch LLP

(57) ABSTRACT

An outer casing for a lighting module comprises a closed base end and a sidewall joined to the closed base end. The sidewall and the closed base end together defining a cavity to contain at least the lighting module. The sidewall comprises: a portion having a substantially cylindrical shape; a lower edge, joined to the portion having the substantially cylindrical shape and located opposite to the closed base end, defining a circular opening; two diametrically opposed flat portions, joined to the portion having the substantially cylindrical shape, starting at and extending from the closed base end; and two sloped portions, each sloped portion of the two sloped portions joining a corresponding flat portion of the two diametrically opposed flat portions to the portion of the sidewall having the substantially cylindrical shape. At least one knockout is disposed on at least one flat portion and on the closed base end.

30 Claims, 8 Drawing Sheets

Related U.S. Application Data continuation of application No. 15/132,875, filed on Apr. 19, 2016, now Pat. No. 10,563,850.

(60) Provisional application No. 62/151,308, filed on Apr. 22, 2015.

(51) Int. Cl.

| | |
|---|---|
| *F21V 21/04* | (2006.01) |
| *F21V 23/06* | (2006.01) |
| *F21V 23/00* | (2015.01) |
| *F21Y 115/15* | (2016.01) |
| *F21Y 115/10* | (2016.01) |

(52) U.S. Cl.

CPC ..... *F21V 23/009* (2013.01); *F21V 23/06* (2013.01); *F21Y 2115/10* (2016.08); *F21Y 2115/15* (2016.08)

(56) References Cited

U.S. PATENT DOCUMENTS

| | | | |
|---|---|---|---|
| 1,856,356 | A | 5/1932 | Owen |
| 2,038,784 | A | 4/1936 | Ghadiali |
| 2,179,161 | A | 11/1939 | Rambusch |
| 2,197,737 | A | 4/1940 | Appleton |
| 2,352,913 | A | 7/1944 | Morrill |
| 2,528,989 | A | 11/1950 | Ammells |
| 2,597,595 | A | 5/1952 | Ordas |
| 2,642,246 | A | 6/1953 | Larry |
| 2,670,919 | A | 3/1954 | Vincent |
| 2,697,535 | A | 12/1954 | Olson |
| 2,758,810 | A | 8/1956 | Good |
| D180,844 | S | 8/1957 | Poliakoff |
| 2,802,933 | A | 8/1957 | Broadwin |
| 2,809,002 | A | 10/1957 | Rudolph |
| 2,998,512 | A | 8/1961 | Duchene et al. |
| 3,023,920 | A | 3/1962 | Cook et al. |
| 3,057,993 | A | 10/1962 | Gellert |
| 3,104,087 | A | 9/1963 | Joseph et al. |
| 3,214,126 | A | 10/1965 | Roos |
| 3,422,261 | A | 1/1969 | McGinty |
| 3,460,299 | A | 8/1969 | Wilson |
| 3,650,046 | A | 3/1972 | Skinner |
| 3,675,807 | A | 7/1972 | Lund et al. |
| 3,700,885 | A | 10/1972 | Bobrick |
| 3,711,053 | A | 1/1973 | Drake |
| D227,989 | S | 7/1973 | Geisel |
| 3,773,968 | A | 11/1973 | Copp |
| 3,812,342 | A | 5/1974 | Mcnamara |
| 3,836,766 | A | 9/1974 | Auerbach |
| 3,874,035 | A | 4/1975 | Schuplin |
| 3,913,773 | A | 10/1975 | Copp et al. |
| D245,905 | S | 9/1977 | Taylor |
| 4,050,603 | A | 9/1977 | Harris et al. |
| 4,062,512 | A | 12/1977 | Arnold |
| 4,088,827 | A | 5/1978 | Kohaut |
| 4,176,758 | A | 12/1979 | Glick |
| 4,280,169 | A | 7/1981 | Allen |
| D267,694 | S | 1/1983 | Moriarty et al. |
| D267,695 | S | 1/1983 | Paquette et al. |
| D267,775 | S | 2/1983 | Holcombe |
| 4,399,497 | A | 8/1983 | Druffel |
| 4,450,512 | A | 5/1984 | Kristofek |
| 4,460,948 | A | 7/1984 | Malola |
| 4,520,435 | A | 5/1985 | Baldwin |
| 4,539,629 | A | 9/1985 | Poppenheimer |
| 4,601,145 | A | 7/1986 | Wilcox |
| 4,667,840 | A | 5/1987 | Lindsey |
| 4,723,747 | A | 2/1988 | Karp et al. |
| 4,729,080 | A | 3/1988 | Fremont et al. |
| 4,754,377 | A | 6/1988 | Wenman |
| 4,770,311 | A | 9/1988 | Wang |
| 4,880,128 | A | 11/1989 | Jorgensen |
| 4,910,651 | A | 3/1990 | Montanez |
| 4,919,292 | A | 4/1990 | Hsu |
| 4,929,187 | A | 5/1990 | Hudson et al. |
| 4,930,054 | A | 5/1990 | Krebs |
| 5,044,582 | A | 9/1991 | Walters |
| D326,537 | S | 5/1992 | Gattari |
| 5,216,203 | A | 6/1993 | Gower |
| 5,222,800 | A | 6/1993 | Chan et al. |
| 5,239,132 | A | 8/1993 | Bartow |
| 5,250,269 | A | 10/1993 | Langer et al. |
| D340,856 | S | 11/1993 | McHugh |
| D341,819 | S | 11/1993 | Carlstrom |
| 5,266,050 | A | 11/1993 | O'Neil et al. |
| 5,291,381 | A | 3/1994 | Price |
| 5,303,894 | A | 4/1994 | Deschamps et al. |
| 5,382,752 | A | 1/1995 | Reyhan et al. |
| 5,420,376 | A | 5/1995 | Rajecki et al. |
| 5,465,199 | A | 11/1995 | Bray et al. |
| 5,505,419 | A | 4/1996 | Gabrius |
| 5,544,870 | A | 8/1996 | Kelly et al. |
| 5,562,343 | A | 10/1996 | Chan et al. |
| 5,571,993 | A | 11/1996 | Jones et al. |
| 5,580,158 | A | 12/1996 | Aubrey et al. |
| 5,588,737 | A | 12/1996 | Kusmer |
| 5,603,424 | A | 2/1997 | Bordwell et al. |
| 5,609,408 | A | 3/1997 | Targetti |
| 5,613,338 | A | 3/1997 | Esposito |
| D381,111 | S | 7/1997 | Lecluze |
| 5,662,413 | A | 9/1997 | Akiyama et al. |
| D386,277 | S | 11/1997 | Lecluze |
| 5,690,423 | A | 11/1997 | Hentz et al. |
| D387,466 | S | 12/1997 | Lecluze |
| 5,738,436 | A | 4/1998 | Cummings et al. |
| 5,778,625 | A | 7/1998 | Druffel et al. |
| 5,836,678 | A | 11/1998 | Wright et al. |
| 5,942,726 | A | 8/1999 | Reiker |
| 5,944,412 | A | 8/1999 | Janos et al. |
| 5,957,573 | A | 9/1999 | Wedekind et al. |
| 6,030,102 | A | 2/2000 | Gromotka |
| 6,033,098 | A | 3/2000 | Hentz et al. |
| 6,076,788 | A | 6/2000 | Akiyama |
| 6,082,878 | A | 7/2000 | Doubek et al. |
| 6,095,669 | A | 8/2000 | Cho |
| 6,098,945 | A | 8/2000 | Korcz |
| 6,105,334 | A | 8/2000 | Monson et al. |
| 6,161,910 | A | 12/2000 | Reisenauer et al. |
| 6,170,685 | B1 | 1/2001 | Currier |
| 6,174,076 | B1 | 1/2001 | Petrakis et al. |
| 6,176,599 | B1 | 1/2001 | Farzen |
| 6,267,491 | B1 | 7/2001 | Parrigin |
| 6,332,597 | B1 | 12/2001 | Korcz et al. |
| 6,350,043 | B1 | 2/2002 | Gloisten |
| 6,350,046 | B1 | 2/2002 | Lau |
| 6,364,511 | B1 | 4/2002 | Cohen |
| 6,375,338 | B1 | 4/2002 | Cummings et al. |
| 6,402,112 | B1 | 6/2002 | Thomas et al. |
| D461,455 | S | 8/2002 | Forbes |
| 6,461,016 | B1 | 10/2002 | Jamison et al. |
| 6,474,846 | B1 | 11/2002 | Kelmelis et al. |
| 6,491,270 | B1 | 12/2002 | Pfaller |
| 6,491,413 | B1 | 12/2002 | Benesohn |
| D468,697 | S | 1/2003 | Straub, Jr. |
| D470,970 | S | 2/2003 | Huang |
| 6,515,313 | B1 | 2/2003 | Ibbetson et al. |
| 6,521,833 | B1 | 2/2003 | DeFreitas |
| D471,657 | S | 3/2003 | Huang |
| 6,583,573 | B2 | 6/2003 | Bierman |
| 6,585,389 | B2 | 7/2003 | Bonazzi |
| 6,600,175 | B1 | 7/2003 | Baretz et al. |
| D478,872 | S | 8/2003 | Heggem |
| 6,632,006 | B1 | 10/2003 | Rippel et al. |
| 6,657,236 | B1 | 12/2003 | Thibeault et al. |
| 6,666,419 | B1 | 12/2003 | Vrame |
| D488,583 | S | 4/2004 | Benghozi |
| 6,719,438 | B2 | 4/2004 | Sevack et al. |
| 6,758,578 | B1 | 7/2004 | Chou |
| 6,777,615 | B1 | 8/2004 | Gretz |
| 6,779,908 | B1 | 8/2004 | Ng |
| 6,827,229 | B2 | 12/2004 | Dinh et al. |
| 6,838,618 | B2 | 1/2005 | Newbold et al. |

(56) References Cited

U.S. PATENT DOCUMENTS

| | | | |
|---|---|---|---|
| 6,889,943 | B2 | 5/2005 | Dinh et al. |
| 6,906,352 | B2 | 6/2005 | Edmond et al. |
| D509,314 | S | 9/2005 | Rashidi |
| 6,948,829 | B2 | 9/2005 | Verdes et al. |
| 6,958,497 | B2 | 10/2005 | Emerson et al. |
| 6,964,501 | B2 | 11/2005 | Ryan |
| 6,967,284 | B1 | 11/2005 | Gretz |
| D516,235 | S | 2/2006 | Rashidi |
| 7,025,477 | B2 | 4/2006 | Blessing |
| 7,064,269 | B2 | 6/2006 | Smith |
| D528,673 | S | 9/2006 | Maxik et al. |
| 7,102,172 | B2 | 9/2006 | Lynch |
| D531,740 | S | 11/2006 | Maxik |
| D532,532 | S | 11/2006 | Maxik |
| 7,148,420 | B1 | 12/2006 | Johnson et al. |
| 7,148,632 | B2 | 12/2006 | Berman et al. |
| 7,154,040 | B1 | 12/2006 | Tompkins |
| 7,170,015 | B1 | 1/2007 | Roesch et al. |
| D536,349 | S | 2/2007 | Humber et al. |
| D537,039 | S | 2/2007 | Pincek |
| D539,229 | S | 3/2007 | Murphey |
| 7,186,008 | B2 | 3/2007 | Patti |
| 7,190,126 | B1 | 3/2007 | Paton |
| 7,211,833 | B2 | 5/2007 | Slater, Jr. et al. |
| 7,213,940 | B1 | 5/2007 | Van De Ven et al. |
| 7,234,674 | B2 | 6/2007 | Rippel et al. |
| D547,889 | S | 7/2007 | Huang |
| D552,969 | S | 10/2007 | Bobrowski et al. |
| D553,267 | S | 10/2007 | Yuen |
| D555,106 | S | 11/2007 | Pape et al. |
| D556,144 | S | 11/2007 | Dinh |
| 7,297,870 | B1 | 11/2007 | Sartini |
| 7,312,474 | B2 | 12/2007 | Emerson et al. |
| 7,320,536 | B2 | 1/2008 | Petrakis et al. |
| D561,372 | S | 2/2008 | Yan |
| D561,373 | S | 2/2008 | Yan |
| 7,335,920 | B2 | 2/2008 | Denbaars et al. |
| D563,896 | S | 3/2008 | Greenslate |
| 7,347,580 | B2 | 3/2008 | Blackman et al. |
| D570,012 | S | 5/2008 | Huang |
| 7,374,308 | B2 | 5/2008 | Sevack et al. |
| D570,504 | S | 6/2008 | Maxik et al. |
| D570,505 | S | 6/2008 | Maxik et al. |
| 7,399,104 | B2 | 7/2008 | Rappaport |
| 7,413,156 | B1 | 8/2008 | Cho |
| 7,429,025 | B1 | 9/2008 | Gretz |
| D578,677 | S | 10/2008 | Huang |
| 7,431,482 | B1 | 10/2008 | Morgan et al. |
| 7,432,440 | B2 | 10/2008 | Hull et al. |
| 7,442,883 | B2 | 10/2008 | Jolly et al. |
| 7,446,345 | B2 | 11/2008 | Emerson et al. |
| 7,470,048 | B2 | 12/2008 | Wu |
| 7,473,005 | B2 | 1/2009 | O'Brien |
| 7,488,097 | B2 | 2/2009 | Reisenauer et al. |
| 7,494,258 | B2 | 2/2009 | McNaught |
| 7,503,145 | B2 | 3/2009 | Newbold et al. |
| 7,510,159 | B2 | 3/2009 | Rippel |
| 7,524,089 | B2 | 4/2009 | Park |
| D591,894 | S | 5/2009 | Flank |
| D592,945 | S | 5/2009 | Mahan |
| 7,534,989 | B2 | 5/2009 | Suehara et al. |
| D596,154 | S | 7/2009 | Rivkin |
| 7,566,154 | B2 | 7/2009 | Gloisten et al. |
| D599,040 | S | 8/2009 | Alexander et al. |
| D600,836 | S | 9/2009 | Hanley et al. |
| 7,588,359 | B2 | 9/2009 | Coushaine et al. |
| 7,592,583 | B2 | 9/2009 | Page et al. |
| D606,696 | S | 12/2009 | Chen et al. |
| 7,625,105 | B1 | 12/2009 | Johnson |
| 7,628,513 | B2 | 12/2009 | Chiu |
| 7,651,238 | B2 | 1/2010 | O'Brien |
| 7,654,705 | B2 | 2/2010 | Czech et al. |
| D611,650 | S | 3/2010 | Broekhoff |
| 7,670,021 | B2 | 3/2010 | Chou |
| 7,673,841 | B2 | 3/2010 | Wronski |
| 7,677,766 | B2 | 3/2010 | Boyer |
| 7,692,182 | B2 | 4/2010 | Bergmann et al. |
| 7,704,763 | B2 | 4/2010 | Fujii et al. |
| D616,118 | S | 5/2010 | Thomas et al. |
| 7,712,922 | B2 | 5/2010 | Hacker et al. |
| 7,722,208 | B1 | 5/2010 | Dupre et al. |
| 7,722,227 | B2 | 5/2010 | Zhang et al. |
| 7,735,795 | B2 | 6/2010 | Wronski |
| 7,735,798 | B2 | 6/2010 | Kojima |
| 7,748,887 | B2 | 7/2010 | Zampini, II et al. |
| 7,766,518 | B2 | 8/2010 | Piepgras et al. |
| 7,769,192 | B2 | 8/2010 | Takagi et al. |
| 7,771,082 | B2 | 8/2010 | Peng |
| 7,771,094 | B2 | 8/2010 | Goode |
| 7,784,754 | B2 | 8/2010 | Nevers et al. |
| D624,691 | S | 9/2010 | Zhang et al. |
| D624,692 | S | 9/2010 | Mackin et al. |
| D625,847 | S | 10/2010 | Maglica |
| D625,876 | S | 10/2010 | Chen et al. |
| 7,810,775 | B2 | 10/2010 | Ponte et al. |
| D627,507 | S | 11/2010 | Lai et al. |
| D627,727 | S | 11/2010 | Alexander et al. |
| 7,828,465 | B2 | 11/2010 | Roberge et al. |
| D629,366 | S | 12/2010 | Ericson et al. |
| 7,845,393 | B2 | 12/2010 | Kao et al. |
| 7,857,275 | B2 | 12/2010 | de la Borbolla |
| 7,871,184 | B2 | 1/2011 | Peng |
| 7,874,539 | B2 | 1/2011 | Wright et al. |
| 7,874,703 | B2 | 1/2011 | Shastry et al. |
| 7,874,709 | B1 | 1/2011 | Beadle |
| D633,224 | S | 2/2011 | Lee |
| 7,909,487 | B1 | 3/2011 | Venetucci et al. |
| D636,117 | S | 4/2011 | Kim et al. |
| D636,118 | S | 4/2011 | Kim et al. |
| D636,903 | S | 4/2011 | Torenbeek |
| D637,339 | S | 5/2011 | Hasan et al. |
| D637,340 | S | 5/2011 | Hasan et al. |
| 7,950,832 | B2 | 5/2011 | Tanaka et al. |
| D639,499 | S | 6/2011 | Choi et al. |
| D640,819 | S | 6/2011 | Pan |
| 7,956,546 | B2 | 6/2011 | Hasnain |
| 7,959,332 | B2 | 6/2011 | Tickner et al. |
| 7,967,480 | B2 | 6/2011 | Pickard et al. |
| D642,317 | S | 7/2011 | Rashidi |
| 7,972,035 | B2 | 7/2011 | Boyer |
| 7,972,043 | B2 | 7/2011 | Schutte |
| D642,536 | S | 8/2011 | Robinson |
| D643,970 | S | 8/2011 | Kim et al. |
| 7,993,037 | B1 | 8/2011 | Buse |
| 8,002,425 | B2 | 8/2011 | Russo et al. |
| D646,011 | S | 9/2011 | Rashidi |
| 8,013,243 | B2 | 9/2011 | Korcz et al. |
| 8,038,113 | B2 | 10/2011 | Fryzek et al. |
| D648,476 | S | 11/2011 | Choi et al. |
| D648,477 | S | 11/2011 | Kim et al. |
| D650,115 | S | 12/2011 | Kim et al. |
| 8,070,328 | B1 | 12/2011 | Knoble et al. |
| 8,096,670 | B2 | 1/2012 | Trott |
| D654,205 | S | 2/2012 | Rashidi |
| D656,262 | S | 3/2012 | Yoshinobu et al. |
| D656,263 | S | 3/2012 | Ogawa et al. |
| 8,142,057 | B2 | 3/2012 | Roos et al. |
| 8,152,334 | B2 | 4/2012 | Krogman |
| D658,788 | S | 5/2012 | Dudik et al. |
| D658,802 | S | 5/2012 | Chen |
| D659,862 | S | 5/2012 | Tsai |
| D659,879 | S | 5/2012 | Rashidi |
| D660,814 | S | 5/2012 | Wilson |
| 8,177,176 | B2 | 5/2012 | Nguyen et al. |
| 8,182,116 | B2 | 5/2012 | Zhang et al. |
| 8,201,968 | B2 | 6/2012 | Maxik et al. |
| D663,058 | S | 7/2012 | Pan |
| D663,466 | S | 7/2012 | Rashidi |
| D664,274 | S | 7/2012 | de Visser et al. |
| D664,705 | S | 7/2012 | Kong et al. |
| 8,215,805 | B2 | 7/2012 | Cogliano et al. |
| 8,220,970 | B1 | 7/2012 | Khazi et al. |
| 8,226,270 | B2 | 7/2012 | Yamamoto et al. |
| 8,235,549 | B2 | 8/2012 | Gingrich, III et al. |

(56) References Cited

U.S. PATENT DOCUMENTS

| | | | |
|---|---|---|---|
| 8,240,630 | B2 | 8/2012 | Wronski |
| D667,155 | S | 9/2012 | Rashidi |
| 8,262,255 | B1 | 9/2012 | Rashidi |
| D668,372 | S | 10/2012 | Renshaw et al. |
| D668,809 | S | 10/2012 | Rashidi |
| D669,198 | S | 10/2012 | Qui |
| D669,199 | S | 10/2012 | Chuang |
| D669,620 | S | 10/2012 | Rashidi |
| 8,277,090 | B2 | 10/2012 | Fryzek et al. |
| D671,668 | S | 11/2012 | Rowlette, Jr. et al. |
| 8,308,322 | B2 | 11/2012 | Santiago et al. |
| D672,899 | S | 12/2012 | Ven et al. |
| D673,869 | S | 1/2013 | Yu |
| D676,263 | S | 2/2013 | Birke |
| D676,814 | S | 2/2013 | Paul |
| 8,376,593 | B2 | 2/2013 | Bazydola et al. |
| D677,417 | S | 3/2013 | Rashidi |
| D677,634 | S | 3/2013 | Korcz et al. |
| D679,044 | S | 3/2013 | Jeswani et al. |
| D679,047 | S | 3/2013 | Tickner et al. |
| 8,403,533 | B1 | 3/2013 | Paulsel |
| 8,403,541 | B1 | 3/2013 | Rashidi |
| 8,405,947 | B1 | 3/2013 | Green et al. |
| D681,259 | S | 4/2013 | Kong |
| 8,408,759 | B1 | 4/2013 | Rashidi |
| D682,459 | S | 5/2013 | Gordin et al. |
| D683,063 | S | 5/2013 | Lopez et al. |
| D683,890 | S | 6/2013 | Lopez et al. |
| D684,269 | S | 6/2013 | Wang et al. |
| D684,287 | S | 6/2013 | Rashidi |
| D684,719 | S | 6/2013 | Rashidi |
| D685,118 | S | 6/2013 | Rashidi |
| D685,120 | S | 6/2013 | Rashidi |
| 8,454,204 | B1 | 6/2013 | Chang et al. |
| D685,507 | S | 7/2013 | Sun |
| D687,586 | S | 8/2013 | Rashidi |
| D687,587 | S | 8/2013 | Rashidi |
| D687,588 | S | 8/2013 | Rashidi |
| D687,980 | S | 8/2013 | Gravely et al. |
| D688,405 | S | 8/2013 | Kim et al. |
| 8,506,127 | B2 | 8/2013 | Russello et al. |
| 8,506,134 | B2 | 8/2013 | Wilson et al. |
| D690,049 | S | 9/2013 | Rashidi |
| D690,864 | S | 10/2013 | Rashidi |
| D690,865 | S | 10/2013 | Rashidi |
| D690,866 | S | 10/2013 | Rashidi |
| D691,314 | S | 10/2013 | Rashidi |
| D691,315 | S | 10/2013 | Samson |
| D691,763 | S | 10/2013 | Hand et al. |
| 8,550,669 | B2 | 10/2013 | Macwan et al. |
| D693,043 | S | 11/2013 | Schmalfuss et al. |
| D693,517 | S | 11/2013 | Davis |
| D694,456 | S | 11/2013 | Rowlette, Jr. et al. |
| 8,573,816 | B2 | 11/2013 | Negley et al. |
| D695,441 | S | 12/2013 | Lui et al. |
| D695,941 | S | 12/2013 | Rashidi |
| D696,446 | S | 12/2013 | Huh |
| D696,447 | S | 12/2013 | Huh |
| D696,448 | S | 12/2013 | Huh |
| 8,602,601 | B2 | 12/2013 | Khazi et al. |
| D698,067 | S | 1/2014 | Rashidi |
| D698,068 | S | 1/2014 | Rashidi |
| 8,622,361 | B2 | 1/2014 | Wronski |
| 8,632,040 | B2 | 1/2014 | Mass et al. |
| D698,985 | S | 2/2014 | Lopez et al. |
| D699,384 | S | 2/2014 | Rashidi |
| D699,687 | S | 2/2014 | Baldwin et al. |
| D700,387 | S | 2/2014 | Snell |
| 8,641,243 | B1 | 2/2014 | Rashidi |
| 8,659,034 | B2 | 2/2014 | Baretz et al. |
| D700,991 | S | 3/2014 | Johnson et al. |
| D701,175 | S | 3/2014 | Baldwin et al. |
| D701,466 | S | 3/2014 | Clifford et al. |
| 8,672,518 | B2 | 3/2014 | Boomgaarden et al. |
| D702,867 | S | 4/2014 | Kim et al. |
| D703,843 | S | 4/2014 | Cheng |
| 8,684,569 | B2 | 4/2014 | Pickard et al. |
| 8,696,158 | B2 | 4/2014 | Santiago et al. |
| D705,472 | S | 5/2014 | Huh |
| D705,481 | S | 5/2014 | Zhang et al. |
| 8,727,582 | B2 | 5/2014 | Brown et al. |
| D708,381 | S | 7/2014 | Rashidi |
| 8,777,449 | B2 | 7/2014 | Ven et al. |
| D710,529 | S | 8/2014 | Lopez et al. |
| 8,801,217 | B2 | 8/2014 | Gehle et al. |
| 8,820,985 | B1 | 9/2014 | Tam et al. |
| 8,833,013 | B2 | 9/2014 | Harman |
| 8,845,144 | B1 | 9/2014 | Davies et al. |
| D714,989 | S | 10/2014 | Rowlette, Jr. et al. |
| 8,870,426 | B2 | 10/2014 | Biebl et al. |
| 8,890,414 | B2 | 11/2014 | Rowlette, Jr. et al. |
| D721,845 | S | 1/2015 | Lui et al. |
| 8,926,133 | B2 | 1/2015 | Booth |
| 8,939,418 | B2 | 1/2015 | Green et al. |
| D722,296 | S | 2/2015 | Taylor |
| D722,977 | S | 2/2015 | Hagarty |
| D722,978 | S | 2/2015 | Hagarty |
| 8,950,898 | B2 | 2/2015 | Catalano |
| D723,781 | S | 3/2015 | Miner |
| D723,783 | S | 3/2015 | Miner |
| D725,359 | S | 3/2015 | Miner |
| 8,967,575 | B1 | 3/2015 | Gretz |
| D726,363 | S | 4/2015 | Danesh |
| D726,949 | S | 4/2015 | Redfern |
| D728,129 | S | 4/2015 | Kreuzbichler |
| 9,004,435 | B2 | 4/2015 | Wronski |
| 9,039,254 | B2 | 5/2015 | Danesh |
| D731,689 | S | 6/2015 | Bernard et al. |
| 9,062,866 | B1 | 6/2015 | Christ et al. |
| 9,065,264 | B2 | 6/2015 | Cooper et al. |
| 9,068,719 | B2 | 6/2015 | Van De Ven et al. |
| 9,068,722 | B2 | 6/2015 | Wronski et al. |
| D734,525 | S | 7/2015 | Gordin et al. |
| D735,012 | S | 7/2015 | Cowie |
| D735,142 | S | 7/2015 | Hagarty |
| 9,078,299 | B2 | 7/2015 | Ashdown |
| 9,109,783 | B1 | 8/2015 | Davis et al. |
| D739,355 | S | 9/2015 | D'Aubeterre |
| D739,590 | S | 9/2015 | Redfern |
| 9,140,441 | B2 | 9/2015 | Goelz et al. |
| D741,538 | S | 10/2015 | Ghasabi |
| 9,151,457 | B2 | 10/2015 | Pickard et al. |
| 9,151,477 | B2 | 10/2015 | Pickard et al. |
| D742,325 | S | 11/2015 | Leung |
| D743,079 | S | 11/2015 | Adair |
| D744,723 | S | 12/2015 | Yoo |
| 9,217,560 | B2 | 12/2015 | Harbers et al. |
| 9,222,661 | B2 | 12/2015 | Kim et al. |
| 9,239,131 | B1 | 1/2016 | Wronski et al. |
| D750,317 | S | 2/2016 | Lui et al. |
| 9,285,103 | B2 | 3/2016 | Van De Ven et al. |
| 9,291,319 | B2 | 3/2016 | Kathawate et al. |
| 9,301,362 | B2 | 3/2016 | Dohn et al. |
| D754,078 | S | 4/2016 | Baldwin et al. |
| D754,079 | S | 4/2016 | Baldwin et al. |
| D754,605 | S | 4/2016 | McMillan |
| 9,303,812 | B2 | 4/2016 | Green et al. |
| 9,310,038 | B2 | 4/2016 | Athalye |
| 9,322,543 | B2 | 4/2016 | Hussell et al. |
| 9,347,655 | B2 | 5/2016 | Boomgaarden et al. |
| 9,366,418 | B2 | 6/2016 | Gifford |
| 9,371,966 | B2 | 6/2016 | Rowlette, Jr. et al. |
| D762,181 | S | 7/2016 | Lin |
| 9,395,051 | B2 | 7/2016 | Hussell et al. |
| D762,906 | S | 8/2016 | Jeswani et al. |
| D764,079 | S | 8/2016 | Wu |
| 9,404,639 | B2 | 8/2016 | Bailey et al. |
| 9,417,506 | B1 | 8/2016 | Tirosh |
| 9,423,110 | B1 | 8/2016 | Newton et al. |
| D766,185 | S | 9/2016 | Hagarty |
| D767,199 | S | 9/2016 | Wronski et al. |
| 9,447,917 | B1 | 9/2016 | Wronski et al. |
| 9,447,953 | B2 | 9/2016 | Lawlor |
| D768,325 | S | 10/2016 | Xu |

(56) References Cited

U.S. PATENT DOCUMENTS

| | | | |
|---|---|---|---|
| D768,326 | S | 10/2016 | Guzzini |
| D769,501 | S | 10/2016 | Jeswani et al. |
| D770,065 | S | 10/2016 | Tittle |
| D770,076 | S | 10/2016 | Li et al. |
| 9,476,552 | B2 | 10/2016 | Myers et al. |
| D774,676 | S | 12/2016 | Ng |
| D776,324 | S | 1/2017 | Gierl et al. |
| D777,967 | S | 1/2017 | Redfern |
| 9,534,751 | B2 | 1/2017 | Maglica et al. |
| D778,241 | S | 2/2017 | Holbrook et al. |
| D778,484 | S | 2/2017 | Guzzini |
| D779,100 | S | 2/2017 | Redfern |
| 9,581,302 | B2 | 2/2017 | Danesh |
| 9,583,926 | B2 | 2/2017 | Ye |
| 9,599,315 | B1 | 3/2017 | Harpenau et al. |
| 9,605,842 | B1 | 3/2017 | Davis |
| 9,605,910 | B2 | 3/2017 | Swedberg et al. |
| D785,228 | S | 4/2017 | Guzzini |
| D786,472 | S | 5/2017 | Redfern |
| D786,473 | S | 5/2017 | Dean |
| D786,474 | S | 5/2017 | Fujisawa |
| D788,330 | S | 5/2017 | Johnson et al. |
| D790,102 | S | 6/2017 | Guzzini |
| 9,673,597 | B2 | 6/2017 | Lee |
| 9,689,541 | B2 | 6/2017 | Wronski |
| D791,709 | S | 7/2017 | Holton |
| D791,711 | S | 7/2017 | Holton |
| D791,712 | S | 7/2017 | Holton |
| 9,696,021 | B2 | 7/2017 | Wronski |
| 9,702,516 | B1 | 7/2017 | Vasquez et al. |
| D795,820 | S | 8/2017 | Wengreen |
| 9,732,904 | B1 | 8/2017 | Wronski |
| 9,732,947 | B1 | 8/2017 | Christ et al. |
| 9,739,464 | B2 | 8/2017 | Wronski |
| D799,105 | S | 10/2017 | Eder et al. |
| D800,957 | S | 10/2017 | Eder et al. |
| 9,791,111 | B1 | 10/2017 | Huang et al. |
| 9,797,562 | B2 | 10/2017 | Dabiet et al. |
| 9,803,839 | B2 | 10/2017 | Visser et al. |
| D805,660 | S | 12/2017 | Creasman et al. |
| D805,881 | S | 12/2017 | Nehls |
| 9,854,642 | B2 | 12/2017 | Kashani |
| D809,176 | S | 1/2018 | Partington |
| 9,860,961 | B2 | 1/2018 | Chemel et al. |
| 9,863,619 | B2 | 1/2018 | Mak |
| D809,465 | S | 2/2018 | Keirstead |
| 9,903,569 | B2 | 2/2018 | O'Brien et al. |
| 9,945,548 | B2 | 4/2018 | Williams et al. |
| 9,964,266 | B2 | 5/2018 | Danesh |
| D819,879 | S | 6/2018 | Oudina et al. |
| D820,494 | S | 6/2018 | Cohen |
| D821,615 | S | 6/2018 | Trice |
| D821,627 | S | 6/2018 | Ko |
| 9,995,441 | B2 | 6/2018 | Power et al. |
| 10,006,613 | B2 | 6/2018 | Oudina et al. |
| D822,505 | S | 7/2018 | Gibson et al. |
| D824,494 | S | 7/2018 | Martins et al. |
| D825,829 | S | 8/2018 | Guo |
| 10,041,638 | B2 | 8/2018 | Vasquez et al. |
| 10,054,274 | B2 | 8/2018 | Athalye et al. |
| D827,903 | S | 9/2018 | Wu |
| 10,072,805 | B2 | 9/2018 | Bailey |
| D832,218 | S | 10/2018 | Wronski et al. |
| D833,977 | S | 11/2018 | Danesh et al. |
| 10,125,959 | B2 | 11/2018 | Cohen |
| 10,139,059 | B2 | 11/2018 | Danesh |
| D834,928 | S | 12/2018 | Lu et al. |
| D836,976 | S | 1/2019 | Reese et al. |
| 10,244,607 | B1 | 3/2019 | Kashani |
| D847,414 | S | 4/2019 | Danesh et al. |
| D847,415 | S | 4/2019 | Danesh et al. |
| 10,247,390 | B1 | 4/2019 | Kopitzke et al. |
| D848,375 | S | 5/2019 | Danesh et al. |
| 10,281,131 | B2 | 5/2019 | Cohen |
| 10,295,163 | B1 | 5/2019 | Cohen |
| D850,695 | S | 6/2019 | Dabiet et al. |
| D851,046 | S | 6/2019 | Peng et al. |
| 10,408,395 | B2 | 9/2019 | Danesh |
| 10,408,396 | B2 | 9/2019 | Wronski et al. |
| 10,408,436 | B2 | 9/2019 | Wronski et al. |
| D863,661 | S | 10/2019 | Tian et al. |
| D864,877 | S | 10/2019 | Danesh et al. |
| D867,653 | S | 11/2019 | Gorman |
| 10,488,000 | B2 | 11/2019 | Danesh et al. |
| 10,541,522 | B2 | 1/2020 | Lalancette |
| 10,551,044 | B2 | 2/2020 | Peng et al. |
| 10,563,850 | B2 | 2/2020 | Danesh |
| D877,957 | S | 3/2020 | Kopitzke, IV |
| 10,591,120 | B2 | 3/2020 | Bailey et al. |
| 10,609,785 | B1 | 3/2020 | Fardadi et al. |
| D880,733 | S | 4/2020 | Lo et al. |
| D883,562 | S | 5/2020 | Hu |
| D885,648 | S | 5/2020 | Zeng |
| D885,649 | S | 5/2020 | McLaughlin, III et al. |
| 10,663,127 | B2 | 5/2020 | Danesh et al. |
| 10,663,153 | B2 | 5/2020 | Nikooyan et al. |
| D888,313 | S | 6/2020 | Xie et al. |
| 10,683,994 | B2 | 6/2020 | Wronski et al. |
| 10,684,003 | B2 | 6/2020 | Wronski et al. |
| D890,410 | S | 7/2020 | Stanford et al. |
| 10,704,745 | B2 | 7/2020 | Sherry et al. |
| 10,753,558 | B2 | 8/2020 | Danesh |
| 10,808,917 | B2 | 10/2020 | Harris et al. |
| 10,816,148 | B2 | 10/2020 | Danesh |
| D901,398 | S | 11/2020 | Danesh et al. |
| D901,745 | S | 11/2020 | Yang |
| D902,871 | S | 11/2020 | Danesh et al. |
| D903,605 | S | 12/2020 | Danesh et al. |
| D905,327 | S | 12/2020 | Williams et al. |
| D907,284 | S | 1/2021 | Danesh et al. |
| D910,223 | S | 2/2021 | Cohen |
| 10,975,570 | B2 | 4/2021 | Shen |
| 10,982,829 | B2 | 4/2021 | Danesh |
| 11,022,259 | B2 | 6/2021 | Bailey et al. |
| 11,028,982 | B2 | 6/2021 | Danesh |
| 11,047,538 | B2 | 6/2021 | Danesh et al. |
| D924,467 | S | 7/2021 | Danesh et al. |
| D925,109 | S | 7/2021 | Danesh et al. |
| 11,060,705 | B1 | 7/2021 | Danesh et al. |
| 11,067,231 | B2 | 7/2021 | Lotfi et al. |
| 11,085,597 | B2 | 8/2021 | Danesh |
| 11,118,768 | B2 | 9/2021 | Danesh |
| D934,665 | S | 11/2021 | Cronkhite et al. |
| D939,134 | S | 12/2021 | Danesh et al. |
| D940,545 | S | 1/2022 | Tanner et al. |
| 11,231,154 | B2 | 1/2022 | Kopitzke et al. |
| D944,212 | S | 2/2022 | Peng et al. |
| 11,242,983 | B2 | 2/2022 | Danesh |
| 11,255,497 | B2 | 2/2022 | Danesh |
| 2002/0172047 | A1 | 11/2002 | Ashley |
| 2003/0006353 | A1 | 1/2003 | Dinh et al. |
| 2003/0016532 | A1 | 1/2003 | Reed |
| 2003/0021104 | A1 | 1/2003 | Tsao |
| 2003/0161153 | A1 | 8/2003 | Patti |
| 2004/0001337 | A1 | 1/2004 | Defouw et al. |
| 2004/0120141 | A1 | 6/2004 | Beadle |
| 2004/0156199 | A1 | 8/2004 | Rivas et al. |
| 2005/0078474 | A1 | 4/2005 | Whitfield |
| 2005/0121215 | A1 | 6/2005 | Halbert |
| 2005/0225966 | A1 | 10/2005 | Hartmann et al. |
| 2005/0227536 | A1 | 10/2005 | Gamache et al. |
| 2005/0231962 | A1 | 10/2005 | Koba et al. |
| 2005/0237746 | A1 | 10/2005 | Yiu |
| 2006/0005988 | A1 | 1/2006 | Jorgensen |
| 2006/0158873 | A1 | 7/2006 | Newbold et al. |
| 2006/0198126 | A1 | 9/2006 | Jones |
| 2006/0215408 | A1 | 9/2006 | Lee |
| 2006/0221620 | A1 | 10/2006 | Thomas |
| 2006/0237601 | A1 | 10/2006 | Rinderer |
| 2006/0243877 | A1 | 11/2006 | Rippel |
| 2006/0250788 | A1 | 11/2006 | Hodge et al. |
| 2006/0262536 | A1 | 11/2006 | Nevers |
| 2006/0262545 | A1 | 11/2006 | Piepgras et al. |
| 2007/0012847 | A1 | 1/2007 | Tai |

(56) References Cited

U.S. PATENT DOCUMENTS

| | | | |
|---|---|---|---|
| 2007/0035951 | A1 | 2/2007 | Tseng |
| 2007/0121328 | A1 | 5/2007 | Mondloch et al. |
| 2007/0131827 | A1 | 6/2007 | Nevers et al. |
| 2007/0185675 | A1 | 8/2007 | Papamichael et al. |
| 2007/0200039 | A1 | 8/2007 | Petak |
| 2007/0206374 | A1 | 9/2007 | Petrakis et al. |
| 2008/0002414 | A1 | 1/2008 | Miletich et al. |
| 2008/0112168 | A1 | 5/2008 | Pickard et al. |
| 2008/0112170 | A1 | 5/2008 | Trott |
| 2008/0112171 | A1 | 5/2008 | Patti et al. |
| 2008/0130308 | A1 | 6/2008 | Behr et al. |
| 2008/0137347 | A1 | 6/2008 | Trott et al. |
| 2008/0165545 | A1 | 7/2008 | O'Brien |
| 2008/0170404 | A1 | 7/2008 | Steer et al. |
| 2008/0224008 | A1 | 9/2008 | Dal Ponte et al. |
| 2008/0232116 | A1 | 9/2008 | Kim |
| 2008/0247181 | A1 | 10/2008 | Dixon |
| 2008/0285271 | A1 | 11/2008 | Roberge et al. |
| 2009/0003009 | A1 | 1/2009 | Tessnow et al. |
| 2009/0034261 | A1 | 2/2009 | Grove |
| 2009/0080189 | A1 | 3/2009 | Wegner |
| 2009/0086484 | A1 | 4/2009 | Johnson |
| 2009/0097262 | A1 | 4/2009 | Zhang et al. |
| 2009/0135613 | A1 | 5/2009 | Peng |
| 2009/0141500 | A1 | 6/2009 | Peng |
| 2009/0141506 | A1 | 6/2009 | Lan et al. |
| 2009/0141508 | A1 | 6/2009 | Peng |
| 2009/0147517 | A1 | 6/2009 | Li |
| 2009/0161356 | A1 | 6/2009 | Negley et al. |
| 2009/0237924 | A1 | 9/2009 | Ladewig |
| 2009/0280695 | A1 | 11/2009 | Sekela et al. |
| 2009/0283292 | A1 | 11/2009 | Lehr |
| 2009/0290343 | A1 | 11/2009 | Brown et al. |
| 2010/0014282 | A1 | 1/2010 | Danesh |
| 2010/0033095 | A1 | 2/2010 | Sadwick |
| 2010/0061108 | A1 | 3/2010 | Zhang et al. |
| 2010/0110690 | A1 | 5/2010 | Hsu et al. |
| 2010/0110698 | A1 | 5/2010 | Harwood et al. |
| 2010/0110699 | A1 | 5/2010 | Chou |
| 2010/0148673 | A1 | 6/2010 | Stewart et al. |
| 2010/0149822 | A1 | 6/2010 | Cogliano et al. |
| 2010/0165643 | A1 | 7/2010 | Russo et al. |
| 2010/0244709 | A1 | 9/2010 | Steiner et al. |
| 2010/0246172 | A1 | 9/2010 | Liu |
| 2010/0259919 | A1 | 10/2010 | Khazi et al. |
| 2010/0270903 | A1 | 10/2010 | Jao et al. |
| 2010/0277905 | A1 | 11/2010 | Janik et al. |
| 2010/0284185 | A1 | 11/2010 | Ngai |
| 2010/0302778 | A1 | 12/2010 | Dabiet et al. |
| 2010/0328956 | A1 | 12/2010 | Zhang |
| 2011/0043040 | A1 | 2/2011 | Porter et al. |
| 2011/0063831 | A1 | 3/2011 | Cook |
| 2011/0068687 | A1 | 3/2011 | Takahasi et al. |
| 2011/0069499 | A1 | 3/2011 | Trott et al. |
| 2011/0080750 | A1 | 4/2011 | Jones et al. |
| 2011/0116276 | A1 | 5/2011 | Okamura et al. |
| 2011/0121756 | A1 | 5/2011 | Thomas et al. |
| 2011/0134634 | A1 | 6/2011 | Gingrich, III et al. |
| 2011/0134651 | A1 | 6/2011 | Berman |
| 2011/0140633 | A1 | 6/2011 | Archenhold |
| 2011/0170294 | A1 | 7/2011 | Mier-Langner et al. |
| 2011/0194299 | A1 | 8/2011 | Crooks et al. |
| 2011/0216534 | A1 | 9/2011 | Tickner et al. |
| 2011/0226919 | A1 | 9/2011 | Fryzek et al. |
| 2011/0255292 | A1 | 10/2011 | Shen |
| 2011/0267828 | A1 | 11/2011 | Bazydola et al. |
| 2011/0285314 | A1 | 11/2011 | Carney et al. |
| 2012/0020104 | A1 | 1/2012 | Biebl et al. |
| 2012/0074852 | A1 | 3/2012 | Delnoij |
| 2012/0106176 | A1 | 5/2012 | Lopez et al. |
| 2012/0113642 | A1 | 5/2012 | Catalano |
| 2012/0140442 | A1 | 6/2012 | Woo et al. |
| 2012/0140465 | A1 | 6/2012 | Rowlette, Jr. et al. |
| 2012/0162994 | A1 | 6/2012 | Wasniewski et al. |
| 2012/0182744 | A1 | 7/2012 | Santiago et al. |
| 2012/0188762 | A1 | 7/2012 | Joung et al. |
| 2012/0243237 | A1 | 9/2012 | Toda et al. |
| 2012/0250321 | A1 | 10/2012 | Blincoe et al. |
| 2012/0266449 | A1 | 10/2012 | Krupa |
| 2012/0268688 | A1 | 10/2012 | Sato et al. |
| 2012/0287625 | A1 | 11/2012 | Macwan et al. |
| 2012/0305868 | A1 | 12/2012 | Callahan et al. |
| 2012/0314429 | A1 | 12/2012 | Plunk |
| 2013/0009552 | A1 | 1/2013 | Page |
| 2013/0010476 | A1 | 1/2013 | Pickard et al. |
| 2013/0016864 | A1 | 1/2013 | Ivey et al. |
| 2013/0033872 | A1 | 2/2013 | Randolph et al. |
| 2013/0050994 | A1 | 2/2013 | Pieper |
| 2013/0051012 | A1 | 2/2013 | Oehle et al. |
| 2013/0077307 | A1 | 3/2013 | Yamamoto |
| 2013/0083529 | A1 | 4/2013 | Gifford |
| 2013/0141913 | A1 | 6/2013 | Sachsenweger |
| 2013/0155681 | A1 | 6/2013 | Nall et al. |
| 2013/0163254 | A1 | 6/2013 | Chang et al. |
| 2013/0170232 | A1 | 7/2013 | Park et al. |
| 2013/0170233 | A1 | 7/2013 | Nezu et al. |
| 2013/0201699 | A1 | 8/2013 | Kato et al. |
| 2013/0227908 | A1 | 9/2013 | Gulbrandsen et al. |
| 2013/0258677 | A1 | 10/2013 | Fryzek et al. |
| 2013/0265750 | A1 | 10/2013 | Pickard et al. |
| 2013/0271989 | A1 | 10/2013 | Hussell et al. |
| 2013/0294084 | A1 | 11/2013 | Kathawate et al. |
| 2013/0301252 | A1 | 11/2013 | Hussell et al. |
| 2013/0322062 | A1 | 12/2013 | Danesh |
| 2013/0322084 | A1 | 12/2013 | Ebisawa |
| 2013/0335980 | A1 | 12/2013 | Nakasuji et al. |
| 2014/0029262 | A1 | 1/2014 | Maxik et al. |
| 2014/0036497 | A1 | 2/2014 | Hussell et al. |
| 2014/0049957 | A1 | 2/2014 | Goelz et al. |
| 2014/0063776 | A1 | 3/2014 | Clark et al. |
| 2014/0071679 | A1 | 3/2014 | Booth |
| 2014/0071687 | A1 | 3/2014 | Tickner et al. |
| 2014/0140490 | A1 | 5/2014 | Roberts et al. |
| 2014/0063818 | A1 | 6/2014 | Randolph et al. |
| 2014/0233246 | A1 | 8/2014 | Lafreniere et al. |
| 2014/0254177 | A1 | 9/2014 | Danesh |
| 2014/0268836 | A1 | 9/2014 | Thompson |
| 2014/0268869 | A1 | 9/2014 | Blessitt et al. |
| 2014/0299730 | A1 | 10/2014 | Green et al. |
| 2014/0313775 | A1 | 10/2014 | Myers et al. |
| 2014/0321122 | A1 | 10/2014 | Domagala et al. |
| 2014/0347848 | A1 | 11/2014 | Pisavadia et al. |
| 2015/0009676 | A1 | 1/2015 | Danesh |
| 2015/0029732 | A1 | 1/2015 | Hatch |
| 2015/0078008 | A1 | 3/2015 | He |
| 2015/0085500 | A1 | 3/2015 | Cooper et al. |
| 2015/0092449 | A1 | 4/2015 | Demuynck et al. |
| 2015/0131301 | A1 | 5/2015 | Ho |
| 2015/0138779 | A1 | 5/2015 | Livesay et al. |
| 2015/0153635 | A1 | 6/2015 | Chen et al. |
| 2015/0176823 | A1 | 6/2015 | Leshniak et al. |
| 2015/0184837 | A1 | 7/2015 | Zhang et al. |
| 2015/0198324 | A1 | 7/2015 | O'Brien et al. |
| 2015/0204491 | A1 | 7/2015 | Yuan et al. |
| 2015/0219317 | A1 | 8/2015 | Gatof et al. |
| 2015/0233556 | A1 | 8/2015 | Danesh |
| 2015/0241039 | A1 | 8/2015 | Fryzek |
| 2015/0263497 | A1 | 9/2015 | Korcz et al. |
| 2015/0276185 | A1 | 10/2015 | Bailey et al. |
| 2015/0308662 | A1 | 10/2015 | Vice et al. |
| 2015/0345761 | A1 | 12/2015 | Lawlor |
| 2015/0362159 | A1 | 12/2015 | Ludyjan |
| 2016/0084488 | A1 | 3/2016 | Wu et al. |
| 2016/0209007 | A1 | 7/2016 | Belmonte et al. |
| 2016/0238225 | A1 | 8/2016 | Doust |
| 2016/0308342 | A1 | 10/2016 | Witherbee et al. |
| 2016/0312987 | A1 | 10/2016 | Danesh |
| 2016/0348860 | A1 | 12/2016 | Danesh |
| 2016/0348861 | A1 | 12/2016 | Bailey et al. |
| 2016/0366738 | A1 | 12/2016 | Boulanger et al. |
| 2017/0003007 | A1 | 1/2017 | Wronski |
| 2017/0045213 | A1 | 2/2017 | Williams et al. |
| 2017/0059135 | A1 | 3/2017 | Jones |
| 2017/0138576 | A1 | 5/2017 | Peng et al. |

(56) References Cited

U.S. PATENT DOCUMENTS

| | | | |
|---|---|---|---|
| 2017/0138581 | A1 | 5/2017 | Doust |
| 2017/0167672 | A1 | 6/2017 | Stauner et al. |
| 2017/0167699 | A1 | 6/2017 | Schubert et al. |
| 2017/0198896 | A1 | 7/2017 | May |
| 2017/0284616 | A1 | 10/2017 | Coakley et al. |
| 2017/0307188 | A1 | 10/2017 | Gudina et al. |
| 2017/0307198 | A1 | 10/2017 | Shah et al. |
| 2018/0112857 | A1 | 4/2018 | Wronski et al. |
| 2018/0142871 | A1 | 5/2018 | Morales |
| 2018/0216809 | A1 | 8/2018 | Cohen |
| 2018/0224095 | A1 | 8/2018 | Cohen |
| 2018/0231197 | A1 | 8/2018 | Danesh |
| 2018/0283677 | A1 | 10/2018 | Cohen |
| 2018/0372284 | A1 | 12/2018 | Danesh et al. |
| 2019/0032874 | A1 | 1/2019 | Bonnetto et al. |
| 2019/0041050 | A1 | 2/2019 | Cairns et al. |
| 2019/0049080 | A1 | 2/2019 | Danesh |
| 2019/0063701 | A1 | 2/2019 | Lotfi et al. |
| 2019/0063724 | A1 | 2/2019 | Vice et al. |
| 2019/0093836 | A1 | 3/2019 | Danesh |
| 2020/0182420 | A1 | 6/2020 | Cohen et al. |
| 2020/0291652 | A1 | 9/2020 | Shen |
| 2020/0355334 | A1 | 11/2020 | Shen et al. |
| 2020/0393118 | A1 | 12/2020 | Danesh et al. |
| 2021/0010647 | A1 | 1/2021 | Danesh et al. |
| 2021/0010663 | A1 | 1/2021 | Nikooyan et al. |
| 2021/0033268 | A1 | 2/2021 | Danesh |
| 2021/0080081 | A1 | 3/2021 | Cohen |
| 2021/0080084 | A1 | 3/2021 | Danesh et al. |
| 2021/0222845 | A1 | 7/2021 | Kopitzke et al. |
| 2021/0364139 | A1 | 11/2021 | Danesh |
| 2022/0018522 | A1 | 1/2022 | Kopitzke et al. |
| 2022/0018523 | A1 | 1/2022 | Vinh et al. |
| 2022/0042664 | A1 | 2/2022 | Lotfi et al. |
| 2022/0049841 | A1 | 2/2022 | Young et al. |

FOREIGN PATENT DOCUMENTS

| | | | |
|---|---|---|---|
| CA | 2691480 | C | 4/2012 |
| CA | 2734369 | A1 | 10/2013 |
| CA | 2561459 | A1 | 11/2013 |
| CA | 2815067 | | 11/2013 |
| CA | 2848289 | A1 | 10/2014 |
| CA | 2998173 | | 7/2018 |
| CN | 2182475 | Y | 11/1994 |
| CN | 201059503 | Y | 5/2008 |
| CN | 201259125 | Y | 6/2009 |
| CN | 101608781 | A | 12/2009 |
| CN | 201636626 | U | 11/2010 |
| CN | 102062373 | A | 5/2011 |
| CN | 202014067 | U | 10/2011 |
| CN | 202392473 | U | 8/2012 |
| CN | 202733693 | U | 2/2013 |
| CN | 103307518 | A | 9/2013 |
| CN | 103322476 | A | 9/2013 |
| CN | 203202661 | U | 9/2013 |
| CN | 203215483 | U | 9/2013 |
| CN | 101498411 | B | 11/2013 |
| CN | 203273663 | U | 11/2013 |
| CN | 203297980 | U | 11/2013 |
| CN | 203628464 | U | 12/2013 |
| CN | 203641919 | U | 6/2014 |
| CN | 204300818 | U | 4/2015 |
| CN | 104654142 | A | 5/2015 |
| CN | 204513161 | U | 7/2015 |
| CN | 204611541 | U | 9/2015 |
| CN | 204786225 | U | 11/2015 |
| CN | 204829578 | U | 12/2015 |
| CN | 103712135 | B | 4/2016 |
| CN | 205606362 | U | 9/2016 |
| CN | 206130742 | U | 4/2017 |
| CN | 103154606 | B | 5/2017 |
| CN | 206222112 | U | 6/2017 |
| CN | 107013845 | A | 8/2017 |
| CN | 107084343 | A | 8/2017 |
| DE | 9109828 | U1 | 2/1992 |
| DE | 199 47 208 | | 5/2001 |
| EP | 1 589 289 | | 10/2005 |
| EP | 1 672 155 | A1 | 6/2006 |
| EP | 1688663 | | 8/2006 |
| EP | 2 306 072 | A1 | 4/2011 |
| EP | 2 453 169 | A2 | 5/2012 |
| EP | 2 193 309 | B1 | 7/2012 |
| EP | 2 735 787 | A1 | 5/2014 |
| EP | 3 104 024 | A1 | 12/2016 |
| GB | 2325728 | | 12/1998 |
| GB | 2427020 | A | 12/2006 |
| GB | 2466875 | | 7/2010 |
| GB | 2471929 | | 1/2014 |
| GB | 2509772 | A | 7/2014 |
| JP | H02113002 | U | 9/1990 |
| JP | 2007091052 | A | 4/2007 |
| JP | 2007265961 | A | 10/2007 |
| JP | 2011060450 | A2 | 3/2011 |
| JP | 2012064551 | A2 | 3/2012 |
| JP | 2015002027 | A2 | 1/2015 |
| JP | 2015002028 | A2 | 1/2015 |
| JP | 2016219335 | A | 12/2016 |
| JP | 2017107699 | A2 | 6/2017 |
| KR | 1020110008796 | A | 1/2011 |
| KR | 1020120061625 | A | 6/2012 |
| MX | 2011002947 | A | 9/2011 |
| TW | 474382 | U | 1/2002 |
| WO | WO 2013/128896 | A1 | 9/2013 |
| WO | WO 2015/000212 | A1 | 1/2015 |
| WO | WO 2016152166 | A2 | 9/2016 |

OTHER PUBLICATIONS

U.S. Appl. No. 14/726,064, filed May 29, 2015, Bailey et al..
U.S. Appl. No. 15/132,875, filed Apr. 19, 2016, Danesh.
U.S. Appl. No. 15/167,682, filed May 27, 2016, Bailey et al..
U.S. Appl. No. 14/942,937, filed Nov. 16, 2015, Peng et al..
U.S. Appl. No. 15/637,742, filed Jun. 29, 2017, Kopitzke, IV.
U.S. Appl. No. 15/688,266, filed Aug. 28, 2017, Lotti et al.
U.S. Appl. No. 15/853,400, filed Dec. 22, 2017, Kashani.
U.S. Appl. No. 15/901,738, filed Feb. 21, 2018, Danesh.
U.S. Appl. No. 15/947,065, filed Apr. 6, 2018, Danesh.
U.S. Appl. No. 16/016,040, filed Jun. 22, 2018, Danesh.
U.S. Appl. No. 16/200,393, filed Nov. 26, 2018, Danesh.
U.S. Appl. No. 29/638,259, filed Feb. 26, 2018, Danesh.
U.S. Appl. No. 29/541,565, filed Oct. 5, 2015, Peng.
U.S. Appl. No. 29/645,941, filed Apr. 30, 2018, Danesh et al.
U.S. Appl. No. 29/653,142, filed Jun. 11, 2018, Danesh et al.
U.S. Appl. No. 29/664,471, filed Sep. 25, 2018, Danesh et al.
U.S. Appl. No. 29/678,478, filed Jan. 29, 2019, Danesh et al.
U.S. Appl. No. 29/678,482, filed Jan. 29, 2019, Danesh et al.
U.S. Appl. No. 29/683,730, filed Mar. 15, 2019, Danesh et al.
U.S. Appl. No. 29/694,475, filed Jun. 11, 2019, Peng et al.
U.S. Appl. No. 16/653,497, filed Oct. 15, 2019, Danesh et al.
U.S. Appl. No. 29/711,198, filed Nov. 29, 2019, Danesh et al.
U.S. Appl. No. 16/690,970, filed Nov. 21, 2019, Nikooyan et al.
U.S. Appl. No. 16/719,361, filed Dec. 18, 2019, Danesh et al.
U.S. Appl. No. 16/522,275 filed Jul. 25, 201, Danesh.
U.S. Appl. No. 16/725,606, filed Dec. 23, 2019, Bailey et al.
U.S. Appl. No. 29/648,046, filed May 17, 2018, Williams.
U.S. Appl. No. 16/779,824, filed Feb. 3, 2020, Danesh.
U.S. Appl. No. 16/779,865, filed Feb. 3, 2020, Danesh et al.
U.S. Appl. No. 29/688,172, filed Apr. 18, 2019, Danesh et al.
U.S. Appl. No. 29/688,143, filed Apr. 18, 2019, Danesh et al.
U.S. Appl. No. 16/883,144, filed May 26, 2020, Nikooyan et al.
U.S. Appl. No. 29/696,830, filed Jul. 1, 2019, Kopitzke.
U.S. Appl. No. 16/182,481, filed Nov. 6, 2018, Kopitzke.
U.S. Appl. No. 29/762,016, filed Dec. 14, 2020, Williams et al.
U.S. Appl. No. 17/118,742, filed Dec. 11, 2020, Danesh et al.
U.S. Appl. No. 29/752,046, filed Sep. 24, 2020, Peng et al.
U.S. Appl. No. 17/229,668, filed Apr. 13, 2021, Shen.
U.S. Appl. No. 17/318,193, filed May 12, 2021, Danesh et al.
U.S. Appl. No. 17/080,080, filed Oct. 26, 2020, Danesh.
U.S. Appl. No. 17/220,779, filed Apr. 1, 2021, Kopitzke et al.

(56) References Cited

OTHER PUBLICATIONS

U.S. Appl. No. 17/395,522, filed Aug. 6, 2021, Danesh.
U.S. Appl. No. 17/385,766, filed Jul. 26, 2021, Kopitzke.
U.S. Appl. No. 17/384,564, filed Jul. 23, 2021, Kopitzke et al.
U.S. Appl. No. 17/381,147, filed Jul. 20, 2021, Lotti et al.
U.S. Appl. No. 17/379,748, filed Jul. 19, 2021, Young et al.
U.S. Appl. No. 17/379,489, filed Jul. 19, 2021, Vinh et al.
U.S. Appl. No. 17/378,214, filed Jul. 16, 2021, Kopitzke et al.
U.S. Appl. No. 17/374,674, filed Jul. 13, 2021, Danesh.
U.S. Appl. No. 17/234,421, filed Apr. 19, 2021, Danesh.
U.S. Appl. No. 29/764,875, filed Jan. 4, 2021, Danesh et al.
U.S. Appl. No. 29/759,492, filed Nov. 23, 2020, Danesh et al.
U.S. Appl. No. 17/099,650, filed Nov. 16, 2020, Danesh et al.
U.S. Appl. No. 29/757,754, filed Nov. 9, 2020, Danesh et al.
Notice of Allowance dated Sep. 16, 2021 from U.S. Appl. No. 16/779,865, 9 pages.
2006 International Building Code, Section 712 Penetrations, Jan. 2006, 4 pages.
Acrich COB Zhaga Module, Product Description, Seoul Semiconductor, Nov. 11, 2016, 39 pages.
<https://www.zhagastandard.org/books/book18/>, Mar. 2017, 5 pages. Accessed on May 14, 2018.
BXUV.GuideInfo, Fire Resistance Ratings—ANSI/UL 263, UL Online Certifications Directory, last updated Nov. 3, 2016, 27 pages.
CEYY.GuideInfo, Outlet Boxes and Fittings Certified for Fire Resistance, UL Online Certifications Directory, last updated May 16, 2013, 2 pages.
Canadian Office Action dated Dec. 23, 2013 from Canadian Application No. 2,778,581, 3 pages.
Canadian Office Action dated Mar. 22, 2016 from Canadian Application No. 2,879,629, 4 pages.
Canadian Office Action dated Dec. 6, 2016 from Canadian Application No. 2,879,629, 3 pages.
Canadian Office Action dated Mar. 9, 2017 from Canadian Application No. 2,931,588, 5 pages.
Canadian Office Action dated Feb. 1, 2016 from Canadian Application No. 2,879,486, 5 pages.
Canadian Office Action dated Jun. 12, 2017 from Canadian Application No. 2,927,601, 4 pages.
Canadian Office Action dated Aug. 11, 2017 from Canadian Application No. 2,941,051, 4 pages.
Cree LED Lamp Family Sales Sheet—Better light is beautiful light, Apr. 24, 2017, 2 pages.
DME Series Installation Instructions, Oct. 18, 2011, 2 pages.
DMF, Inc., "dmfLIGHTING: LED Recessed Lighting Solutions," Info sheets, Mar. 15, 2012, 4 pages.
DMF, Inc., "dmfLIGHTING: LED Recessed Downlighting," DRD2 Product Brochure, Oct. 23, 2014, 50 pages.
DMF, Inc., "dmfLIGHTING: LED Recessed Downlighting," Product Catalog, Aug. 2012, 68 pages.
Final Office Action dated Apr. 27, 2016 from U.S. Appl. No. 14/184,601, 19 pages.
Final Office Action dated Jul. 26, 2017 from U.S. Appl. No. 14/184,601, 18 pages.
Final Office Action dated Jan. 29, 2016 from U.S. Appl. No. 14/183,424, 21 pages.
Final Office Action dated Jun. 23, 2016 from U.S. Appl. No. 13/484,901, 18 pages.
Final Office Action dated Apr. 2, 2015 from U.S. Appl. No. 13/484,901, 13 pages.
Halo, Halo LED H4 H7 Collection, SustainabLEDesign, Cooper Lighting, (emphasis on p. 18 "H7 Collection LED Modules—Halo LED H7 Module Features,") Mar. 28, 2012, 52 pages.
Halo, H7 LED Downlight Trims 49x Series, 6-inch LED Trims for Use with MI7x LED Modules, Cooper Lighting, ADV110422, rev. Aug. 12, 2011, 15 pages.
Halo, LED Module ML706x, Cooper Lighting, General Installation for All Modules/p. 1; Tether Installation/pp. 2-3; Installation into HALO H750x Series LED—only (Non-Screw Based), Recessed Fixture, p. 4, Oct. 20, 2009, 4 pages.
"Membrane Penetrations in Fire-Resistance Rated Walls," https://www.ul.com/wp-content/uploads/2014/04/ul_MembranePenetrations.pdf, Issue 1, 2009, published Feb. 26, 2010, 2 pages.
"Metallic Outlet Boxes," UL 514A, Underwriters Laboratories, Inc., Feb. 16, 2004 (Title Page Reprinted Aug. 10, 2007), 106 pages.
"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.
Notice of Allowance dated Mar. 26, 2018 for U.S. Appl. No. 14/184,601, 10 pages.
Non-Final Office Action dated Mar. 15, 2010 from U.S. Appl. No. 12/100,148, 8 pages.
Non-Final Office Action dated Apr. 30, 2010 from U.S. Appl. No. 12/173,232, 13 pages.
Non-Final Office Action dated Sep. 5, 2014 from U.S. Appl. No. 13/791,087, 8 pages.
Non-Final Office Action dated Jul. 20, 2015 from U.S. Appl. No. 14/184,601, 16 pages.
Non-Final Office Action dated Dec. 15, 2016 from U.S. Appl. No. 14/184,601, 18 pages.
Non-Final Office Action dated Feb. 6, 2018 from U.S. Appl. No. 15/167,682, 9 pages.
Non-Final Office Action dated Sep. 15, 2015 from U.S. Appl. No. 13/484,901, 16 pages.
Non-Final Office Action dated Oct. 16, 2014 from U.S. Appl. No. 13/484,901, 11 pages.
Non-Final Office Action dated Sep. 6, 2017 from U.S. Appl. No. 14/726,064, 8 pages.
Non-Final Office Action dated May 17, 2017 from U.S. Appl. No. 14/183,424, 20 pages.
Non-Final Office Action dated Jun. 2, 2015 from U.S. Appl. No. 14/183,424, 20 pages.
Non-Final Office Action dated Apr. 12, 2018 for U.S. Appl. No. 29/638,259, 5 pages.
Non-Final Office Action dated May 16, 2018 for U.S. Appl. No. 15/132,875, 18 pages.
Notice of Allowance dated Jan. 30, 2015 from U.S. Appl. No. 13/791,087, 9 pages.
Notice of Allowance dated Jan. 16, 2015 from U.S. Appl. No. 29/467,026, 9 pages.
Notice of Allowance dated Oct. 21, 2016 from U.S. Appl. No. 13/484,901, 7 pages.
Notice of Allowance dated Mar. 24, 2016 from U.S. Appl. No. 14/247,149, 8 pages.
Notice of Allowance dated May 22, 2018 from U.S. Appl. No. 14/183,424, 9 pages.
Notice of Allowance dated May 10, 2018 from U.S. Appl. No. 14/726,064, 7 pages.
Notice of Allowance dated Aug. 23, 2017 from Canadian Application No. 2,879,629, 1 page.
"Outlet Boxes for Use in Fire Rated Assemblies," https://www.ul.com/wp-content/uploads/2014/04/Ul_outletboxes.pdf, Apr. 2007, 2 pages.
Notice of Allowance dated Sep. 21, 2018 from U.S. Appl. No. 29/645,941, 5 pages.
"Advanced LED Solutions," Imtra Marine Lighting. Jun. 17, 2011. 39 pages.
"Portland Bi-Color, Warm White/Red," item:ILIM30941.Imtra Marine Products. 2012. 3 pages. Accessed athttp://www.imtra.com:80/0ade25fb-3218-4cae-a926-6abe64ffd93a/lighting-light-fixtures-downlights-3-to-4-inches-detail.htm on Jan. 25, 2013.
"Cree LMH2 LED Modules," Mouser Electronics. Accesssed at www.mouser.com/new/cree/creelmh2 on Sep. 9, 2012. 2 pages.
"Cree LMH2 LED Module with TrueWhite Technology," Cree Product Family Data Sheet. Dec. 21, 2011. 3 pages.
"Cree LMH2 LED Modules Design Guide," Cree Product Design Guide. 2011. 20 pages.
"Undercabinet Pucks, Xyris Mini LED Puck Light," ELCO Lighting. Sep. 2018. 1 page.
"LED Undercabinet Pocket Guide," ELCO Lighting. Nov. 2, 2016. 12 pages.
"Versi LED Mini Flush," Lithonia Lghting. Sep. 2013. 6 pages.

(56) References Cited

OTHER PUBLICATIONS

Notice of Allowance dated Oct. 4, 2018 from U.S. Appl. No. 15/947,065, 9 pages.
Notice of Allowance dated Sep. 19, 2018 from U.S. Appl. No. 15/167,682, 7 pages.
Non-Final Office Action dated Jun. 25, 2018 for U.S. Appl. No. 29/541,565, 10 pages.
Non-Final Office Action dated Oct. 24, 2018 for U.S. Appl. No. 15/688,266, 14 pages.
OneFrame Recessed LED Downlight. Dmflighting.com. Published Jun. 6, 2018. Retrieved at https://www.dmflighting.com/product/oneframeon Jun. 6, 2018. 11 pages.
Notice of Allowance dated Oct. 9, 2018 from U.S. Appl. No. 29/653,142, 7 pages.
International Search Report and Written Opinion in PCT/US2018/048357 dated Nov. 14, 2018, 13 pages.
Notice of Allowance dated Nov. 27, 2018 from U.S. Appl. No. 15/167,682, 11 pages.
Non-Final Office Action dated Dec. 5, 2018 from U.S. Appl. No. 14/942,937, 13 pages.
International Search Report and Written Opinion in International Patent Application No. PCT/US18/39048 dated Dec. 14, 2018. 24 pages.
Notice of Allowance dated Jan. 2, 2019 from U.S. Appl. No. 29/541,565, 6 pages.
RACO 4 i+A882:C958n. Octagon Welded Concrete Ring, 3-1/2 in. Deep with 1/2 and 3/4 in. Knockouts and ilcludes 890 cover (20-Pack). Model # 280. Accessed at https://www.homedepot.com/p/RACO-4-in-Octagon-Welded-Concrete-Ring-3-1-2-in-Deep-with-1-2-and-3-4-in-Knockouts-and-ilcludes-890-cover-20-Pack-280/203638679 on Jan. 18, 2019. 3 pages.
RACO 4 in. Octagon Welded Concrete Ring, 6 in. Deep with 1/2 and 3/4 in. Knockouts (10-Pack). Model # 276. Accessed at https://www.homedepot.com/p/RACO-4-in-Octagon-Welded-Concrete-Ring-6-in-Deep-with-1-2-and-3-4-in-Knockouts-10-Pack-276/203638675 on Jan. 16, 2019. 4 pages.
Notice of Allowance dated Feb. 8, 2019 from U.S. Appl. No. 29/541,565, 5 pages.
Non-Final Office Action dated Feb. 7, 2019 from U.S. Appl. No. 16/200,393, 32 pages.
Notice of Allowance dated Jan. 28, 2019 from U.S. Appl. No. 29/664,471, 8 pages.
Non-Final Office Action dated Jul. 24, 2018 from U.S. Appl. No. 29/638,259, 5 pages.
Final Office Action dated Mar. 15, 2019 from U.S. Appl. No. 15/132,875, 15 pages.
International Search Report and Written Opinion in International Patent Application No. PCT/US18/62868 dated Mar. 14, 2019, 13 pages.
CS&E PCT Collaborative Search and Examination Pilot Upload Peer Contribution in International Patent Application No. PCT/US18/62868 mailed Mar. 14, 2019, 61 pages.
Notice of Allowance dated Apr. 1, 2019 from U.S. Appl. No. 15/167,682, 7 pages.
Non-Final Office Action dated Apr. 4, 2019 from U.S. Appl. No. 29/678,482, 8 pages.
Notice of Allowance dated Apr. 8, 2019 from U.S. Appl. No. 29/653,142, 8 pages.
Notice of Allowance dated Apr. 17, 2019 from U.S. Appl. No. 29/678,478, 7 pages.
International Search Report and Written Opinion in International Patent Application No. PCT/US18/67614 dated Apr. 25, 2019, 20 pages.
CS&E PCT Collaborative Search and Examination Pilot Upload Peer Contribution in International Patent Application No. PCT/US18/67614 mailed Apr. 24, 2019, 53 pages.
Specification & Features 4" Octagonal Concrete Box Covers. Orbit Industries, Inc. Accessed at https://www.orbitelectric.com on May 6, 2019. 1 page.
4" Octagon Concrete Boxes and Back Plates. Appleton. Accessed at www.appletonelec.com on May 6, 2019. 1 page.
RACO Commercial, Industrial and Residential Electrical Products. Hubbell. Accessed at www.Hubbell-RTB.com on May 6, 2019. 356 pages.
Imtra Marine Lighting 2008 Catalog. 40 pages.
Imtra Marine Lighting 2009 Catalog. 32 pages.
Imtra Marine Lighting Spring 2007 Catalog. 36 pages.
Final Office Action dated Jun. 6, 2019 from U.S. Appl. No. 15/688,266, 7 pages.
Non-Final Office Action dated Jun. 11, 2019 from U.S. Appl. No. 15/901,738, 6 pages.
Notice of Allowance dated Jun. 12, 2019 from U.S. Appl. No. 16/016,040, 8 pages.
Cooper Lighting Halo ML56 LED System Product Sheet. Mar. 2, 2015. Accessed at http://www.cooperindustries.com/content/dam/public/lighting/products/documents/halo/spec_sheets/halo-ml56600-80cri-141689-sss.pdf. 8 pages.
KWIKBRACE® New Construction Braces for Lighting Fixtures or Ceiling Fans 1-1/2 in. Depth. Hubbel. Accessed at https://hubbellcdn.com/specsheet/926.pdf on Jun. 27, 2019. 1 page.
IC1JB Housing 4" IC-Rated New Construction Junction Box Housing. AcuityBrands. Accessed at https://www.acuitybrands.com/en/products/detail/845886/juno/ic1jb-housing/4-ic-rated-new-construction-junction-box-housing on Jun. 27, 2019.
Ex-Parte Quayle Action mailed Jun. 27, 2019 from U.S. Appl. No. 29/683,730, 5 pages.
Notice of Allowance dated Jul. 31, 2019 from U.S. Appl. No. 15/167,682, 7 pages.
Supplemental Notice of Allowance dated Aug. 5, 2019 from U.S. Appl. No. 15/947,065, 2 pages.
International Search Report and Written Opinion in International Patent Application No. PCT/US19/32281 dated Aug. 2, 2019, 18 pages.
Notice of Allowance dated Sep. 11, 2019 from U.S. Appl. No. 29/653,142, 6 pages.
Notice of Allowance dated Sep. 19, 2019 from U.S. Appl. No. 16/016,040, 7 pages.
Corrected Notice of Allowance dated Sep. 27, 2019 from U.S. Appl. No. 15/167,682, 2 pages.
Final Office Action dated Sep. 27, 2019 from U.S. Appl. No. 16/200,393, 34 pages.
Notice of Allowance dated Feb. 15, 2019 from U.S. Appl. No. 15/947,065, 9 pages.
Notice of Allowance dated Oct. 1, 2019 from U.S. Appl. No. 14/942,937, 7 pages.
Final Office Action dated Oct. 5, 2019 from U.S. Appl. No. 29/678,482, 6 pages.
Delhi Rehab & Nursing Facility ELM16-70884. Vertex Innovative Solutions Feb. 25, 2016. 89 pages.
SlimSurface surface mount downlighting. Philips Lightolier 2018. 8 pages.
Be seen in the best light. Lightolier by signify. Comprehensive 2019 Lighting Catalog. 114 pages.
Corrected Notice of Allowance dated Oct. 10, 2019 from U.S. Appl. No. 16/016,040, 2 pages.
Cree® LMR2 LED Module. Product Family Data Sheet Cree 2011. 3 pages.
Notice of Allowance dated Oct. 16, 2019 from U.S. Appl. No. 15/132,875, 12 pages.
International Search Report and Written Opinion in International Patent Application No. PCT/US2019/036477 dated Oct. 17, 2019, 15 pages.
ML56 LED Lighting System 600 / 900 / 1200 Series Halo. Cooper Lighting Brochure 2015. Accessed at https://images.homedepot-static.com/catalog/pdfImages/06/06d28f93-4bf6-45be-a35a-a0239606f227.pdf. 41 pages.
Switch and Outlet Boxes and Covers Brochure. Appelton 2010. 77 pages.
Non-Final Office Action dated Dec. 30, 2019 from U.S. Appl. No. 16/653,497, 8 pages.
Notice of Allowance dated Feb. 5, 2020 from U.S. Appl. No. 15/901,738, 8 pages.

(56) References Cited

OTHER PUBLICATIONS

Notice of Allowance dated Feb. 5, 2020 from U.S. Appl. No. 29/678,482 , 13 pages.
Maxim Lighting Wafer Trifold Brochure LMXBRO1711 2017. Accessed at https://www.maximlighting.com/Upload/download/brochure/pdf/LMXBRO1711.pdf on Feb. 13, 2020. 2 pages.
Maxim Convert Fixture. LMXCAT1805 Maxim Main Catalog 2018 p. 639.
Maxim Wafer. LMXCAT1805 Maxim Main Catalog 2018 pp. 636-638.
Maxim Lighting Trim Trifold LMXBR01905 2019. Accessed at https://www.maximlighting.com/Upload/download/brochure/pdf/LMXBRO1905.pdf on Feb. 13, 2020. 2 pages.
International Search Report and Written Opinion in International Patent Application No. PCT/US2019/054220 dated Feb. 24, 2020, 23 pages.
Final Office Action dated Mar. 17, 2020 for U.S. Appl. No. 29/653,142, 13 pages.
LED Book Pr ice Guide 2012. DMF Light. Issued Jun. 26, 2013. 3 pages.
DLER411 4" Recessed LED Retrofit Module. DMF Light. Issued Jun. 15, 2011. 1 page.
DLEI411 4" Recessed LED New Construction, IC. DMF Light. Issued Nov. 30, 2011. 1 page.
DLEIR411 4" Recessed LED Remodel, IC. DMF Light. Issued Jun. 15, 2011. 1 page.
3 &4" DLE Series LED Sample Case Now Available. DMF Light. Issued Jan. 6, 2012. 1 page.
DLEI3 3" Recessed LED New Construction, IC. DMF Light. Issued Nov. 30, 2011. 2 pages.
Ridgway-Barnes, SlimSurface LED Downlight: One of the thinnest LED surface mount downlights in the market. Philips Lighting Blog. Oct. 28, 2014. Accessed at http://applications.nam.lighting.philips.com/blog/index.php/2014/10/28/slimsurface-led-downlight-one-of-the-thinnest-led-surface-mount-downlights-in-the-market/. 3 pages.
SlimSurface LED S5R, S7R & S10R Round 5", 7" and 10" Apertures. Lightolier by Signify. Nov. 2018. 9 pages.
Non-Final Office Action dated Apr. 2, 2020 for U.S. Appl. No. 16/522,275, 21 pages.
Notice of Allowance dated May 18, 2020 from U.S. Appl. No. 15/901,738, 7 pages.
Non-Final Office Action dated May 20, 2020 for U.S. Appl. No. 15/688,266, 6 pages.
Non-Final Office Action dated May 26, 2020 for U.S. Appl. No. 16/719,361, 10 pages.
Maxim Lighting International, "Wafer LED 7" RD 3000K Wall/Flush Mount", undated.
Maxim Lighting International, "Convert LED Flush Mount", undated.
Maxim Lighting International, "Views of the Wafer Flush Mount", undated.
Maxim Lighting International, "Product/Drawing Specification Sheet", undated.
International Search Report and Written Opinion in PCT/US2020/017331 dated Jun. 22, 2020, 16 pages.
Taiwan Office Action and translation thereof dated Jun. 12, 2020 from Taiwan Application No. 108116564, 8 pages.
Access Lighting Installation Instructions. No. 20870LEDD/20871LEDD/20872LEDD. Dec. 16, 2019. 2 pages.
Model No. 20870LEDD-WH/ACR Infinite Specification Sheet. Access Lighting. Apr. 9, 2020. 1 page.
Notice of Allowance dated Apr. 9, 2020 from U.S. Appl. No. 16/653,497, 7 pages.
Notice of Allowance dated Jul. 10, 2020 from U.S. Appl. No. 29/694,475, 6 pages.
Corrected Notice of Allowability dated Oct. 25, 2018 from U.S. Appl. No. 14/183,424, 3 pages.
Dmf DRD2 Recessed LED Downlight General Retrofit Junction Box Dated: Dec. 18, 2015 Downloaded Jul. 28, 2018, from https://www.a Iconlighting.com/specsheets/DMF/DRD2-Junction-Box-Retrofit-Spec-Sheet .pdf, 6 pages.
Dmf DRD2 Recessed LED Downlight General New Construction 4", 5", 6" Aperture Dated: Apr. 31, 2016 Downloaded Jul. 28, 2018, from https://www. cansandfans.com/sites/default/files/DRD2-General-New-Construction-Spec-Sheet_7_0 .pdf, 9 pages.
Mar. 5, 2016—The DMF Lighting DRD2 Recessed LED Downlight General Retrofit Junction Box—Wet Location Rated is the ideal solution for Commercial LED recessed lighting retrofit applications. web cache https://www.alconlighting.com/dmf-drd2m.html (downloaded Jul. 28, 2018), 6 pages.
Ex Parte Quayle Office Action mailed Oct. 16, 2018 for U.S. Appl. No. 29/663,037, 7 pages.
Notice of Allowance dated Nov. 19, 2018 from U.S. Appl. No. 29/663,037, 5 pages.
Notice of Allowance dated Nov. 15, 2018 from U.S. Appl. No. 29/663,040, 5 pages.
LED modules advance in performance, standardization questions persist (MAGAZINE). LEDs Magazine. Oct. 29, 2013. Accessed at https://www.ledsmagazine.com/leds-ssl-design/modular-light-engines/article/16695073/led-modules-advance-in-performance-standardization-questions-persist-magazine. 9 pages.
Notice of Allowance dated Jul. 20, 2020 from U.S. Appl. No. 29/648,046, 5 pages.
Octagon Concrete Box Cover with (3) 1/2 in. & (2) 3/4 in. Conduit Knockouts. Garvin. Accessed at https://www.garvinindustries.com/covers-and-device-rings/concrete-slab-box-covers-adaptor-rings/flat-covers-all-styles/cbp?gclid=Cj0KCQjw9b_4BRCMARIsADMUIypJc0K80UHdDTI9C5m4BDzR3U87PRYV1NdQIBFxEWQ2l_3otTCTqEkaAi_DEALw_wcB on Jul. 20, 2020. 1 page.
Notice of Allowance dated Jul. 28, 2020 from U.S. Appl. No. 16/719,361, 8 pages.
Notice of Allowance dated Jul. 29, 2020 from U.S. Appl. No. 16/522,275, 8 pages.
Non-Final Office Action dated Aug. 19, 2020 for U.S. Appl. No. 16/886,365, 16 pages.
Notice of Allowance dated Sep. 8, 2020 from U.S. Appl. No. 29/678,482, 5 pages.
Corrected Notice of Allowance dated Sep. 11, 2020 from U.S. Appl. No. 16/719,361, 2 pages.
Canadian Office Action in Application No. 2931588 dated Aug. 13, 2020, 5 pages.
Corrected Notice of Allowance dated Sep. 14, 2020 from U.S. Appl. No. 16/522,275, 2 pages.
Notice of Allowance dated Sep. 22, 2020 from U.S. Appl. No. 29/683,730, 6 pages.
Notice of Allowance dated Sep. 22, 2020 from U.S. Appl. No. 29/653,142, 6 pages.
Notice of Allowance dated Oct. 27, 2020 from U.S. Appl. No. 29/648,046, 5 pages.
Notice of Allowance dated Oct. 27, 2020 from U.S. Appl. No. 29/694,475, 5 pages.
Notice of Allowance dated Nov. 10, 2020 from U.S. Appl. No. 29/688,143, 6 pages.
Notice of Allowance dated Nov. 10, 2020 from U.S. Appl. No. 29/688,172, 6 pages.
Non-Final Office Action dated Nov. 30, 2020 from U.S. Appl. No. 17/000,702, 7 pages.
Notice of Allowance dated Dec. 2, 2020 from U.S. Appl. No. 29/746,262, 6 pages.
International Search Report and Written Opinion in PCT/US2020/050767 dated Dec. 9, 2020, 25 pages.
Non-Final Office Action dated Dec. 16, 2020 from U.S. Appl. No. 17/080,080, 28 pages.
Canadian Office Action in Application No. 2941051 dated Dec. 8, 2020, 5 pages.
Final Office Action dated Jan. 11, 2021 from U.S. Appl. No. 15/688,266, 7 pages.
Non-Final Office Action dated Jan. 11, 2021 from U.S. Appl. No. 16/725,606, 7 pages.
Non-Final Office Action dated Jan. 13, 2021 from U.S. Appl. No. 17/085,636, 14 pages.

(56) References Cited

OTHER PUBLICATIONS

Notice of Allowance dated Jan. 15, 2021 from U.S. Appl. No. 17/000,702, 7 pages.
Notice of Allowance dated Jan. 22, 2021 from U.S. Appl. No. 17/080,080, 14 pages.
Notice of Allowance dated Jan. 22, 2021 from U.S. Appl. No. 16/886,365, 7 pages.
Final Office Action dated Feb. 5, 2021 from U.S. Appl. No. 16/200,393, 7 pages.
"Electrical Boxes" accessed at http://electrical-inspector.blogspot.com/2013/06/electrical-boxes.html Jun. 22, 2013 retrieved from Wayback Machine Archinve.org on Jan. 25, 2021. 12 pages.
"Electrical Boxes Volume and Fill Calculations" accessed at http://electrical-inspector.blogspot.com/2013/06/electrical-boxes-Volume-and-Fill-Calculations.html Jun. 22, 2013 retrieved from Wayback Machine Archinve.org on Jan. 25, 2021. 8 pages.
U.S. Appl. No. 61/881,162, filed Sep. 23, 2013. Priority application to US Publication No. 2015/0085500 to Cooper et al. 31 pages.
Non-Final Office Action dated Jan. 19, 2021 from U.S. Appl. No. 17/099,650, 15 pages.
Supplemental Notice of Allowance dated Mar. 10, 2021 from U.S. Appl. No. 16/886,365, 2 pages.
Notice of Allowance dated Apr. 6, 2021 from U.S. Appl. No. 16/200,393, 11 pages.
Non-Final Office Action dated Apr. 12, 2021 from U.S. Appl. No. 29/694,475, 11 pages.
Notice of Allowance dated Apr. 13, 2021 from U.S. Appl. No. 16/725,606, 7 pages.
Notice of Allowance dated Apr. 26, 2021 from U.S. Appl. No. 17/080,080, 11 pages.
Corrected Notice of Allowance dated Apr. 28, 2021 from U.S. Appl. No. 16/725,606, 2 pages.
Notice of Allowance dated May 5, 2021 from U.S. Appl. No. 17/085,636, 8 pages.
Notice of Allowance dated May 14, 2021 from U.S. Appl. No. 16/881,686, 8 pages.
Notice of Allowance dated May 28, 2021 from U.S. Appl. No. 16/779,824, 11 pages.
Supplemental Notice of Allowance dated Aug. 13, 2021 1 from U.S. Appl. No. 16/779,824, 3 pages.
Notice of Allowance dated May 17, 2021 from U.S. Appl. No. 15/688,266, 9 pages.
Notice of Allowance dated May 24, 2021 from U.S. Appl. No. 29/688,143, 6 pages.
Notice of Allowance dated May 24, 2021 from U.S. Appl. No. 29/688,172, 6 pages.
Notice of Allowance dated May 27, 2021 from U.S. Appl. No. 16/779,865, 9 pages.
Notice of Allowance dated Jun. 1, 2021 from U.S. Appl. No. 16/719,361, 7 pages.
Corrected Notice of Allowance dated Jun. 21, 2021 from U.S. Appl. No. 16/779,865, 3 pages.
Non-Final Office Action dated Jul. 14, 2021 from U.S. Appl. No. 17/118,742, 11 pages.
Notice of Allowance dated Jul. 21, 2021 from U.S. Appl. No. 17/318, 13 pages.
Supplemental Notice of Allowance dated Aug. 19, 2021 1 from U.S. Appl. No. 17/318,193, 4 pages.
Notice of Allowance dated Aug. 20, 2021 1 from U.S. Appl. No. 29/764,875, 5 pages.
Petition for Inter Partes Review of U.S. Pat. No. 9,964,266 Pursuant to 37 C.F.R. § 42.100 et seq. *AMP Plus Inc. dbd ELCO Lighting* v. *DMF, Inc,* IPR2019-01094 filed May 17, 2019. 108 pages.
IPR2019-01094 Exhibit 1001. U.S. Pat. No. 9,964,266 ("the '266 Patent"). 14 pages.
IPR2019-01094 Exhibit 1002. Declaration of Eric Bretschneider, Ph.D. ("Bretschneider"). 107 pages.
IPR2019-01094 Exhibit 1003. Curriculum Vitae of Dr. Bretschneider. 11 pages.
IPR2019-01094 Exhibit 1004. Excerpts from the File History of U.S. Pat. No. 9,964,266. 105 pages.
IPR2019-01094 Exhibit 1005. Imtra 2011 Marine Lighting Catalog—Advanced LED Solutions ("Imtra 2011"). 40 pages.
IPR2019-01094 Exhibit 1006. Imtra 2007 Marine Lighting Catalog ("Imtra 2007"). 36 pages.
IPR2019-01094 Exhibit 1007. U.S. Pat. No. 9,366,418 ("Gifford"). 9 pages.
IPR2019-01094 Exhibit 1008. Declaration of Colby Chevalier ("Chevalier"). 89 pages.
IPR2019-01094 Exhibit 1009. U.S. Pat. No. 7,102,172 ("Lynch"). 41 pages.
IPR2019-01094 Exhibit 1010. Illuminating Engineering Society, ANSI RP-16-10, Nomenclature and Definitions for Illuminating Engineering (approved as an American National Standard Jul. 15, 2005, approved by the IES Board of Directors Oct. 15, 2005). 4 pages.
IPR2019-01094 Exhibit 1011. Underwriters Laboratories Inc. Standard for Safety, Standard UL-8750, entitled Light Emitting Diode (LED) Equipment for Use in Lighting (1st ed. 2009). 5 pages.
IPR2019-01094 Exhibit 1012. Celanese CoolPoly® D5502 Thermally Conductive Liquid Crystalline Polymer Specification ("CoolPoly"). 1 page.
IPR2019-01094 Exhibit 1013. Illuminating Engineering Society of North America, IES Lighting Handbook (John E. Kaufman and Howard Haynes eds., Application vol. 1981) ("Lighting Handbook"). 5 pages.
IPR2019-01094 Exhibit 1014. California Energy Commission, PIER Lighting Research Program: Project 2.3 Low-profile LED Luminaires Final Report (Prepared by Lighting Research Center, Jan. 2005) ("PIER LRP"). 70 pages.
IPR2019-01094 Exhibit 1015. Jim Sinopoli, Using DC Power to Save Energy and End the War on Currents, GreenBiz (Nov. 15, 2012), https://www.greenbiz.com/news/2012/11/15/using-dc-power-save-energy-end-war-currents ("Sinopoli"). 6 pages.
IPR2019-01094 Exhibit 1016. Robert W. Johnson, "Thought Leadership White Paper: AC Versus DC Power Distribution" (Nov. 2012) ("Johnson"). 10 pages.
IPR2019-01094 Exhibit 1017. Lumileds, LUXEON Rebel General Purpose Product Datasheet, Specification DS64 (2016) ("Luxeon Rebel"). 26 pages.
IPR2019-01094 Exhibit 1018. U.S. Pat. No. 8,454,204 ("Chang"). 11 pages.
IPR2019-01094 Exhibit 1019. U.S. Department of Energy, CALiPER Benchmark Report: Performance of Incandescent A-Type and Decorative Lamps and LED Replacements (prepared by Pacific National Laboratory, Nov. 2008) ("CALiPER 2008"). 25 pages.
IPR2019-01094 Exhibit 1020. U.S. Pat. No. 3,836,766 ("Auerbach"). 13 pages.
IPR2019-01094 Exhibit 1021. U.S. Department of Energy, CALiPER Application Summary Report 16: LED BR30 and R30 Lamps (prepared by Pacific Northwest National Laboratory, Jul. 2012) ("CALiPER 2012"). 26 pages.
IPR2019-01094 Exhibit 1022. Sandia National Laboratories, Sandia Report: "The Case for a National Research Program on Semiconductor Lighting" (Jul. 2000) ("Haitz"). 24 pages.
IPR2019-01094 Exhibit 1023. Sylvania, Post Top Street Light LED Retrofit Kit Specification, LED40POST (2009) ("Sylvania"). 4 pages.
IPR2019-01094 Exhibit 1024. Webster's New Collegiate Dictionary (1973) ("Webster's"). 2 pages.
IPR2019-01094 Exhibit 1025. 3M Wire Connectors and Tools Catalog 2013 ("3M Catalog"). 22 pages.
IPR2019-01094 Exhibit 1026. Wakefield Semiconductor Heat Sinks and Thermal Products 1974 Catalog ("Wakefield"). 3 pages.
IPR2019-01094 Exhibit 1027. U.S. Department of Energy, Solid-State Lighting Research and Development Portfolio: Multi-Year Program Plan FY'07-FY'12 (prepared by Navigant Consulting, Inc., Mar. 2006) ("DOE 2006"). 129 pages.
IPR2019-01094 Exhibit 1028. U.S. Department of Energy, Solid-State Lighting ResearA1023:C1043elopment: Multi-Year Program Plan (Apr. 2013) ("DOE 2013"). 89 pages.

(56) References Cited

OTHER PUBLICATIONS

Declaration of Colby Chevalier from Central District of California Civil Docket for Case #: 2:18-cv-07090-CAS-GJS filed Jun. 3, 2019, signed Jun. 3, 2019. 2 pages.
Docket Listing in Inter Partes Review of U.S. Pat. No. 9,964,266. Docket Navegator *AMP Plus, Inc. d/b/a Elco Lighting et al.* v. *DMF, Inc.* PTAB-IPR2019-01094. Downloaded Mar. 25, 2020. 4 pages.
Petition for Inter Partes Review of U.S. Pat. No. 9,964,266 Pursuant to 37 C.F.R. § 42.100 et seq. *AMP Plus Inc. dbd ELCO Lighting* v. *Dmf, Inc,* PTAB-IPR2019-01500 filed Aug. 14, 2019. 99 pages.
Docket Listing in Inter Partes Review of U.S. Pat. No. 9,964,266 . *AMP Plus, Inc. d/b/a ELCO Lighting et al.* v. *DMF, Inc.* PTAB-IPR2019-01500. Downloaded Mar. 25, 2020. 3 pages.
Civil Action No. 2:18-cv-07090. Complaint For Infringement And Unfair Competition. *DMF, Inc.* v. *AMP Plus, Inc. d/b/a ELCO Lighting.* 52 pages. Dated Aug. 15, 2018.
Docket Listing in Civil Action No. 2:18-cv-07090. *DMF, Inc.* v. *AMP Plus, Inc. d/b/a ELCO Lighting et al.* CDCA-2-18-CV-07090. Downloaded on Mar. 25, 2020. 39 pages.
Civil Action No. 2:19-cv-4519.Complaint For Patent Infringement. *DMF, Inc.* v. *AMP Plus, Inc. d/b/a ELCO Lighting.* 52 pages dated May 22, 2019. 23 pages.
Docket Listing in Civil Action No. 2:19-cv-4519. *DMF Inc* v. *AMP Plus, Inc. d/b/a ELCO Lighting et al.* CDCA-2-19-CV-04519. Downloaded on Mar. 25, 2020. 3 pages.
Decision Denying Institution of Inter Partes Review of U.S. Pat. No. 9,964,266 in IPR2019-01500 dated Mar. 17, 2020. 21 pages.
Defendants' Notice of Prior Art Pursuant To 35 U.S.C. § 282 in Civil Action No. 2:18-cv-07090-CAS-GJS dated Feb. 28, 2020. 7 pages.
Defendant *AMP Plus, Inc.'s* Opposition to DMF's Motion for Summary Judgement in Civil Action No. 2:18-cv-07090-CAS-GJS filed Feb. 10, 2020. 32 pages.
Declaration of Eric Bretschneider, Ph.D In Support of Amp Plus, Inc.'s Opposition to DMF, Inc.'s Motion for Partial Summary Judgment in Civil Action No. 2:18-cv-07090-CAS-GJS filed Feb. 10, 2020. 210 pages.
Plaintiff *DMF's* Reply in Support of Motion For Partial Summary Judgment in Civil Action No. 2:18-cv-07090-CAS-GJS filed Feb. 18, 2020. 33 pages.
Declaration of James R. Benya In Support of Plaintiff DMF's Motion for Summary Judgment in Civil Action No. 2:18-cv-07090-CAS-GJS filed Feb. 3, 2020. 193 pages.
Underwriters Laboratories Inc. Standard for Safely. UL 1598. Luminaires Jan. 11, 2020. 12 pages.
Exceptional LED Lighting Technology Product Portfolio. LightingScience 2012. 11 pages.
"Cree LMH2 LED Modules," Mouser Electronics. Sep. 9, 2012. 4 pages.
Slim Line Disc. EYE LEDs Specification Sheet 2012. 2 pages.
HiBay LED Heat Sink. Wakefield-vette. Dec. 11, 2017. 1 pages.
Thermal Management of Cree® XLamp® LEDs. Cree Application Note. 2004. 19 pages.
Imtra Marine Lighting Fall 2007 Catalog. 32 pages.
Cree LMH2 LED Modules Product Family Data Sheet. Cree 2011-2014, 18 pages.
Cree LMH2 LED Modules Design Guide. Cree 2011-2015, 23 pages.
Brochure of Elco EL49A, EL49ICA, EL49RA modules. ELCO Lighting Nov. 25, 2009. 1 page.
Image of Elco E347/247 module identified by Elco in response to DMF's Request for Production in Civil Action No. 2:18-cv-07090-CAS-GJS on Aug. 28, 2019. 1 page.
Screenshots from the Deposition of Brandon Cohen in Civil Action No. 2:18-cv-07090-CAS-GJS. Conducted Sep. 2, 2020. 8 pages.
Defendant *AMP Plus, Inc.'s* Initial Disclosure and Designation of Expert Witnesses in Civil Action No. 2:19-CV-4519-CAS. 37 pages.
Defendant *AMP Plus, Inc. D/B/A Elco Lighting's* Supplemental Responses to Plaintiff *DMF, Inc.'s* First Set of Interrogatories (Nos. 1-16) in Civil Action No. 2:19-CV-4519-CAS, Redacted. 13 pages.
Final Written Decision in IPR2019-01094 dated Nov. 19, 2020, 58 pages.
Non-Final Office Action dated Oct. 18, 2021 from U.S. Appl. No. 29/696,830, 8 pages.
Notice of Allowance dated Nov. 3, 2021 from U.S. Appl. No. 17/220,779, 7 pages.
Notice of Allowance dated Nov. 5, 2021 1 from U.S. Appl. No. 17/318,193, 11 pages.
Non-Final Office Action dated Nov. 5, 2021 from U.S. Appl. No. 17/379,748, 8 pages.
Notice of Allowance dated Nov. 8, 2021 1 from U.S. Appl. No. 29/764,875, 5 pages.
Non-Final Office Action dated Nov. 15, 2021 from U.S. Appl. No. 17/374,674, 7 pages.
Final Office Action dated Nov. 16, 2021 from U.S. Appl. No. 17/099,650,14 pages.
Notice of Allowance dated Nov. 22, 2021 from U.S. Appl. No. 29/694,475, 7 pages.
Notice of Allowance dated Nov. 24, 2021 from U.S. Appl. No. 17/234,421, 9 pages.
Non-Final Office Action dated Nov. 30, 2021 from U.S. Appl. No. 17/395,522, 28 pages.
Non-Final Office Action dated Dec. 1, 2021 from U.S. Appl. No. 16/883,144, 23 pages.
Corrected Notice of Allowance dated Dec. 10, 2021 from U.S. Appl. No. 17/234,421, 2 pages.
Non-Final Office Action dated Dec. 13, 2021 from U.S. Appl. No. 29/711,198, 8 pages.
Corrected Notice of Allowance dated Jan. 11, 2022 from U.S. Appl. No. 29/694,475, 2 pages.
Corrected Notice of Allowance dated Jan. 12, 2022 from U.S. Appl. No. 16/779,865, 9 pages.
Non-Final Office Action dated Jan. 21, 2022 from U.S. Appl. No. 17/229,668, 5 pages.
Notice of Allowance from U.S. Appl. No. 17/379,748 dated Feb. 16, 2022, 5 pages.
Non-Final Office Action dated Feb. 16, 2022 from U.S. Appl. No. 29/743,066, 6 pages.
Notice of Allowance dated Mar. 11, 2022 from U.S. Appl. No. 17/118,742 13 pages.
Non-Final Office Action dated Feb. 25, 2022 from U.S. Appl. No. 17/384,564 28 pages.

OUTER CASING FOR A RECESSED LIGHTING FIXTURE

CROSS-REFERENCE TO RELATED APPLICATIONS

This application is a continuation application of U.S. application Ser. No. 16/779,824, filed Feb. 3, 2020, entitled "OUTER CASING FOR A RECESSED LIGHTING FIXTURE," which is a continuation application of U.S. application Ser. No. 15/132,875, filed Apr. 19, 2016, entitled "OUTER CASING FOR A RECESSED LIGHTING FIXTURE," which claims priority to U.S. Provisional Patent Application No. 62/151,308, filed Apr. 22, 2015, entitled "OUTER CASING FOR A RECESSED LIGHTING FIXTURE." Each of the aforementioned applications is incorporated by reference herein in its entirety.

FIELD

An embodiment of the invention relates to an outer casing for a recessed lighting fixture that houses a unified light source module and driver, and that is directly attached to a set of hangar bars without the use of a horizontally oriented frame. Other embodiments are also described.

BACKGROUND

Recessed lighting fixtures are typically installed or mounted into an opening in a ceiling or a wall. Modern recessed lighting fixtures generally consist of a trim, a light source module, a driver circuit, a legacy incandescent "can" in which the light source module and driver circuit are housed, a junction box, and a set of hangar bars to which a horizontally oriented frame or platform is directly attached. The can and junction box are attached to the horizontally oriented platform. The combination of the can and junction box attached to the horizontal platform is bulky and expensive to manufacture. Moreover, the can and the junction box once attached to the platform cannot be adjusted vertically or horizontally.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. Also, in the interest of conciseness and reducing the total number of figures, a given figure may be used to illustrate the features of more than one embodiment of the invention, and not all elements in the figure may be required for a given embodiment.

DETAILED DESCRIPTION

Several embodiments are described with reference to the appended drawings. While numerous details are set forth, it is understood that some embodiments of the invention may be practiced without these details. In other instances, well-known circuits, structures, and techniques have not been shown in detail so as not to obscure the understanding of this description.

Figure 1:
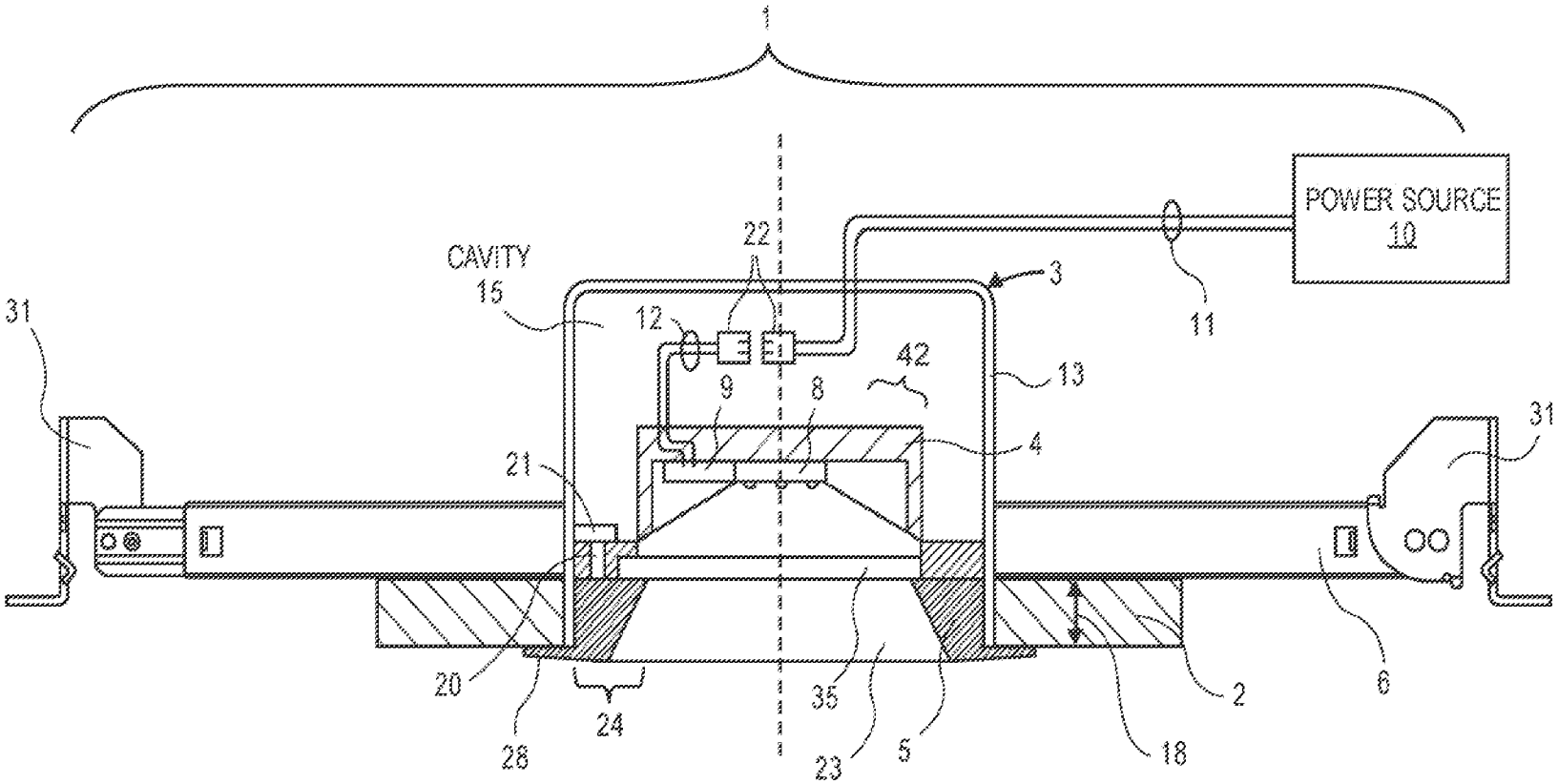
FIG. 1 shows a front cross-section view of an outer casing, with a unified casting positioned inside the outer casing, coupled to hangar bars according to one embodiment.

FIG. 1 shows a cross-section view of a recessed lighting fixture or system 1 installed so that the exposed edge of the ceiling or wall 2, where a hole is formed, is covered. The recessed lighting fixture 1 may include an outer casing 3, a unified casting 4, a trim 5, a set of hangar bars 6, and a set of hangar holders 7 (shown in a side view in FIG. 2 and also in FIG. 4). The unified casting 4 may house both a light source module 8 (e.g. a module of several LED elements) and a driver 9 in a single compact unit (referred to herein as a lighting module 42). The trim 5 serves the primary purpose of covering the exposed edge of the ceiling or wall where a hole is formed in which the recessed lighting fixture 1 resides while still allowing light from a light source module 8 to be emitted into a room through an aperture 23 of the trim 5 to illuminate the room. In doing so, the trim 5 helps the recessed lighting fixture 1 appear seamlessly integrated into the ceiling or wall. The trim 5 may be attached to the outer casing 3 also to hide at least the periphery at the bottom edge of the outer casing 3 from view. This can be seen in FIG. 1 where a flange 28 extends outward from a trim base 24 so as to hide from view (below the light fixture) the bottom edge of the casing 3. As will be described in further detail below, the recessed lighting fixture 1 provides a more compact and cost effective design that also allows the outer casing 3 to be moved so that its position relative to the hangar bars 6 can be adjusted, while complying with various building and safety codes/regulations. Each of the elements of the recessed lighting fixture 1 will be explained by way of example below.

Instead of using a junction box that is mounted along with a can to a horizontal platform (which is in turn attached to a joist or other structural member behind the ceiling or wall 2), as is already known in the art, the outer casing 3 may be used in such a way that obviates the need for a separate junction box and that also eliminates the horizontal platform. As seen FIG. 2 and in FIG. 3, the outer casing 3, and in particular its sidewall 13, is directly attached to a hangar bar 6 via a hangar holder 7. The hangar bar 6 is in turn attached directly to a joist, beam, or other structural member behind the ceiling or wall 2 at a mounting block 31*a*, 31*b*, so that the aperture 23 of the trim 5 will be aligned with and covers the hole in the wall 2. The outer casing 3 may serve as both a protective barrier between wall insulation materials and wiring junctions inside its cavity, and as a luminaire enclosure. As shown in FIG. 1, the outer casing 3 is a structure that separates the inner components of the recessed lighting fixture 1, i.e., those that are located inside the outer casing 3, including electrical wires/cables 11, 12 and connectors 22 that electrically connect a driver 9 in the unified casting 4 to an external power source 10, from items such as thermal/heat insulation materials and the power source 10 that are outside of the outer casing 3 and inside a ceiling or crawl space in which the outer casing has been installed. In one embodiment, the outer casing 3 may accommodate a wall thickness 18 of the ceiling or wall 2 of ½ inch to 2½ inches. The outer casing 3 may have a fire rating of up to two hours without any need for modification, where the fire rating is described in the National Electrical Code (NEC) and by the Underwriters Laboratories (UL) such as specified in UL 263. The outer casing 3 may receive electrical wires 11 into its cavity from the power source 10, such as an electrical power distribution system (e.g., 120 VAC or 277 VAC) within a building or structure in which the recessed lighting fixture 1 is installed. There may be one or more wire connectors 22 inside the outer casing 3 that join one or more wires 11 which carry 120/277 VAC power and that extend into the casing, to deliver 120/277 VAC power from a circuit breaker or wall switch to the driver 9. The electrical wires 11 from the power source 10 may thus be connected inside the outer casing 3 to corresponding wires 12 of the driver 9 which is inside the unified casting 4, as will be described in greater detail below.

Figure 4:
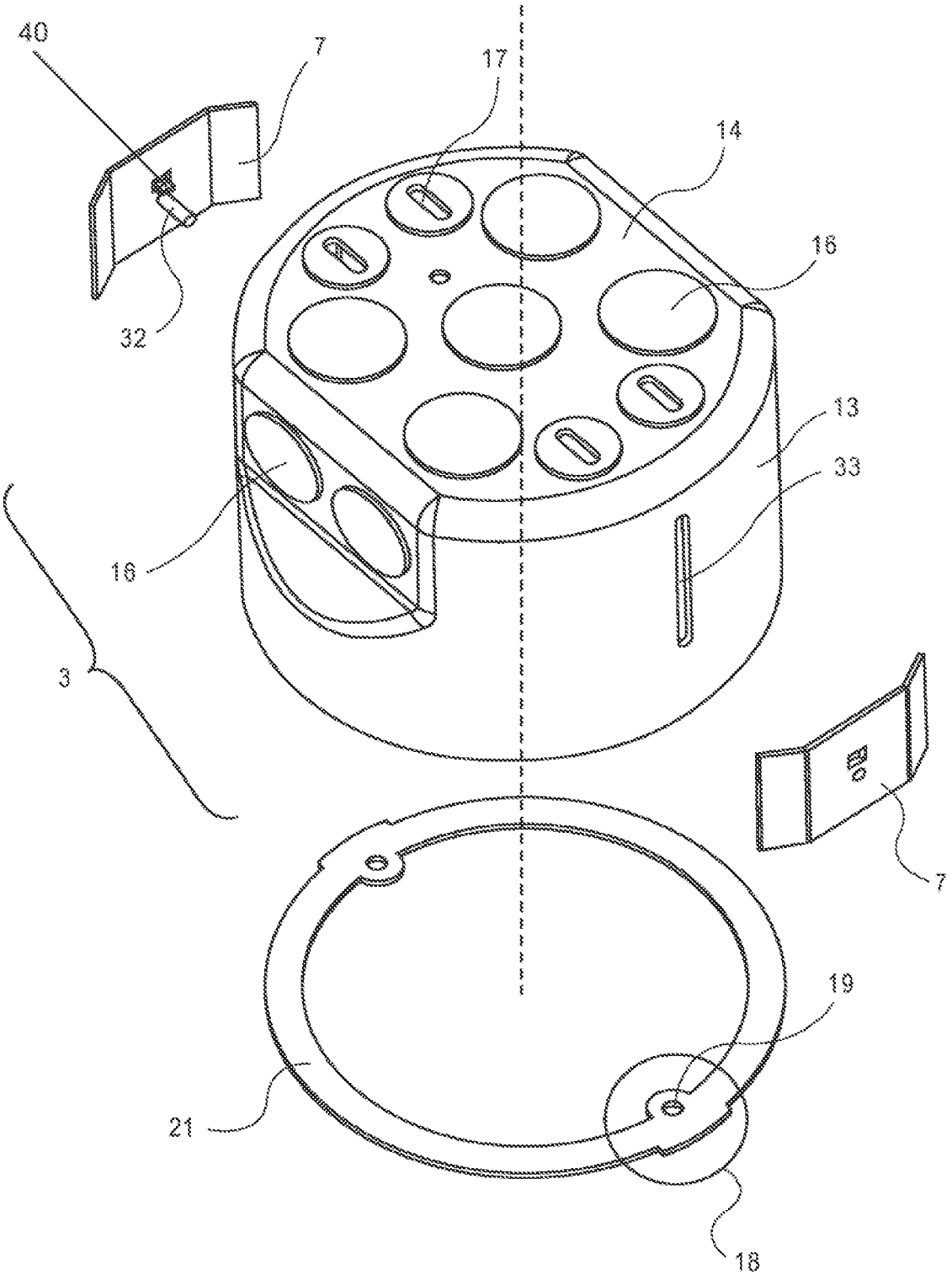
FIG. 4 shows an overhead perspective view of an outer casing, hangar holders, and a ring according to one embodiment.
Figure 5:
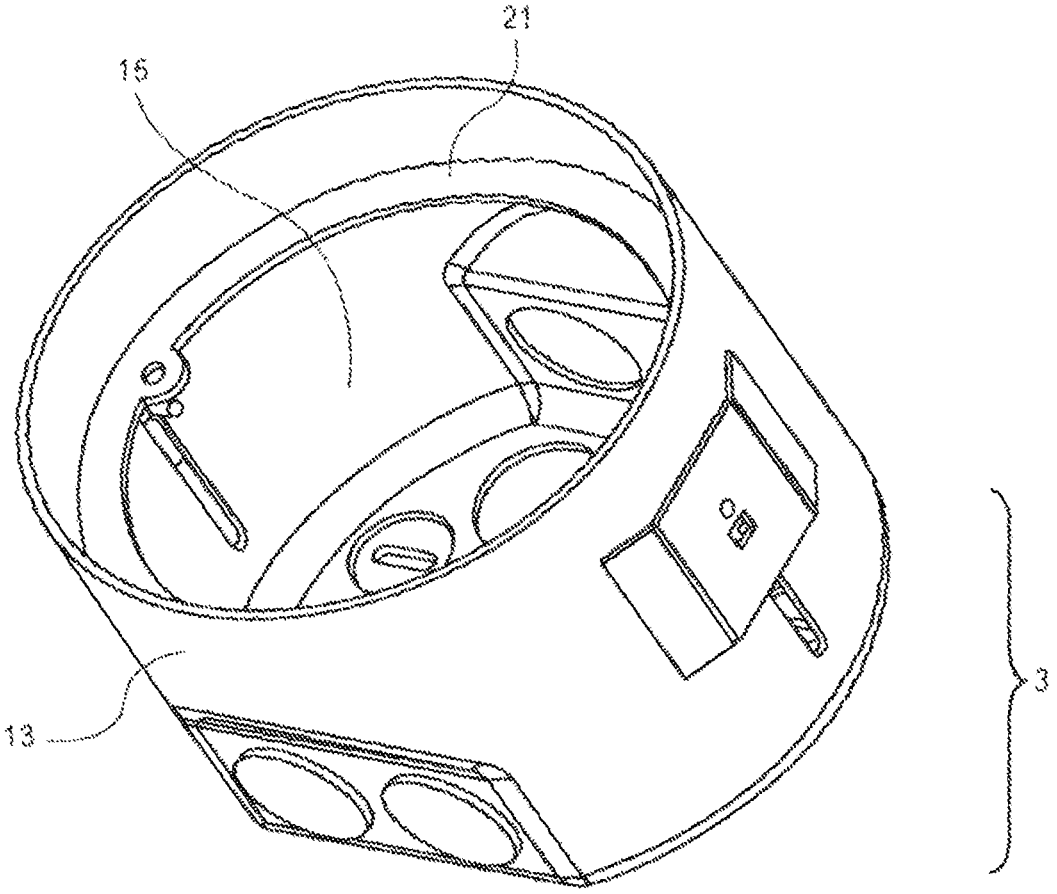
FIG. 5 shows an underneath perspective view of the embodiment of FIG. 4 with the ring inserted into the cavity of the outer casing.

As shown in FIG. 4, the outer casing 3 may have a side wall 13 that extends from and is joined at its upper edge (or upper end) to a closed base end 14, which together define a cavity 15 therein (see FIG. 1 and FIG. 5). The side wall 13 may surround the cavity 15, with its lower edge (or lower end) defining the perimeter of an opening through which various components can be placed inside the cavity 15, including for example, a ring 21, the unified casting 4, and the trim 5, as shown in FIG. 4, FIG. 5, and in FIG. 1. In one embodiment, as shown in FIG. 5, the lower edge (lower end) of the sidewall 13 is devoid of any tabs that extend inward (towards a center vertical axis that is shown as a dotted line). While the side wall 13 is depicted in the relevant figures here as being cylindrical, in other embodiments the side wall 13 of the outer casing 3 have any suitable shape, including a polyhedron, ellipsoid, frusto-conical, or otherwise curved. The cavity 15 that is formed in the outer casing 3 is larger than the outside dimensions of the unified casting 4 such that the entirety of the unified casting 4 fits into the cavity 15—see the front and side views in FIG. 1 and FIG. 2. The unified casting 4 may or may not come into direct contact with the side wall 13 of the outer casing 3. The outer casing 3 is less than 5 inches in height between its base end and the other end of its sidewall.

As seen in FIG. 4, the outer casing 3 may have on its base end 14 one or more knockouts 16 as shown. The knockouts 16 may be punched through and removed to leave an opening behind on the base end 14, for electrical wires 11 or 12 to be inserted through the opening (which wires serve to deliver power to the driver 9). As shown in the top view of FIG. 3, one or more knockouts 16 may also have smaller openings 17 in them (e.g., a slit, slot, etc., that is smaller than the opening that results when the knockout 16 has been removed from the base end 14) that may allow the electrical wires 11 or 12 to be inserted through without the need to punch through the knockouts 16. The knockout 16 may be more than ½ inch in diameter. In one embodiment, one or more of the knockouts 16 allow for the installation therethrough of a non-metallic sheathed cable (as the wires 11). As shown in FIG. 4, one or more of the knockouts 16 may also be positioned on the side wall 13 of the outer casing 3.

In one embodiment, as shown in FIG. 1, the electrical wires 11 received by the outer casing 3 from a power source 10 (e.g. the electrical system of a building or structure) may be connected to the electrical wires 12 of the unified casting 4. As shown, the electrical wires 11 and 12 are connected together through the use of connectors 22 that may be contained within the outer casing 3 (together with the unified casting 4). The term "connector" here is used broadly to not just interlocking or mating connector pairs but also cover wire terminal blocks and wire caps or other devices. In one embodiment, the connectors 22 may be kept outside the outer casing 3 (while the unified casting 4 is retained inside) if the wires 12 are long enough to reach outside of the casing 3. The electrical wires 12 of the unified casting 4 may terminate in a connection with the driver 9 installed within the unified casting 4. When the wires 11 and 12 are connected to each other, electricity may pass from the power source 10 to the driver 9 to enable the driver 9 to power the light source module 8. In one embodiment, the driver 8 has three or more current carrying electrical wires 12.

Figure 6:
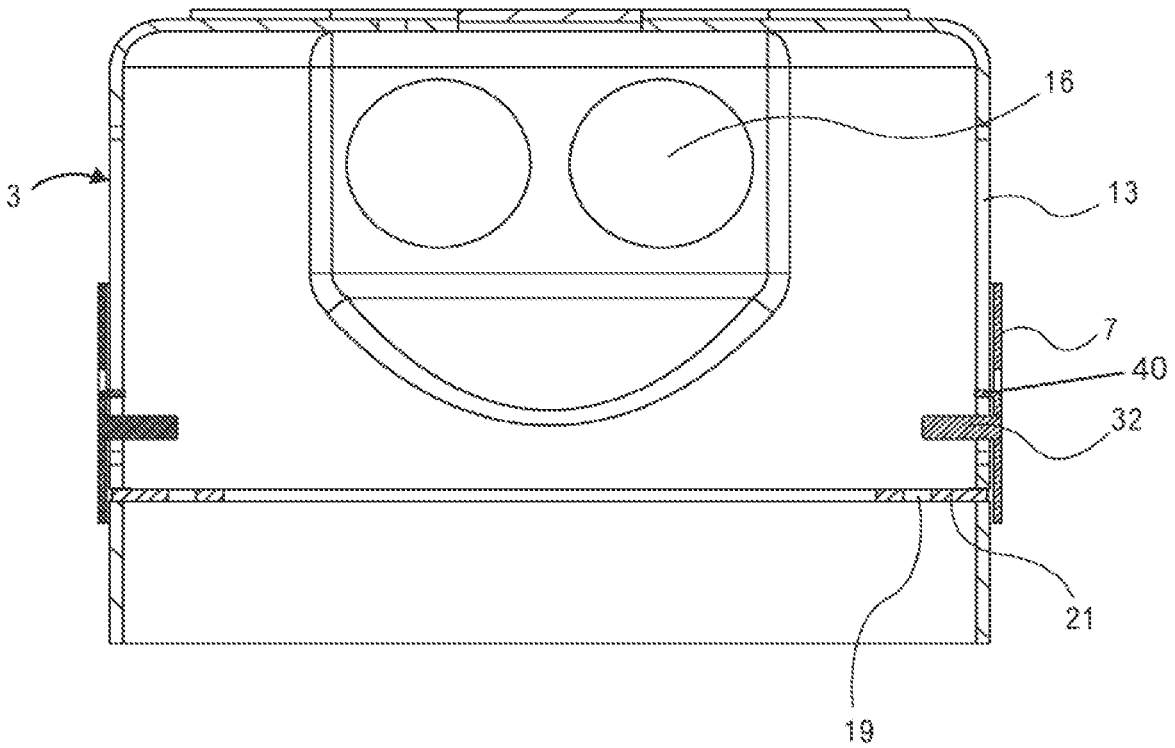
FIG. 6 shows a side cross-section view of an outer casing with hangar holders and a ring according to one embodiment.
Figure 7:
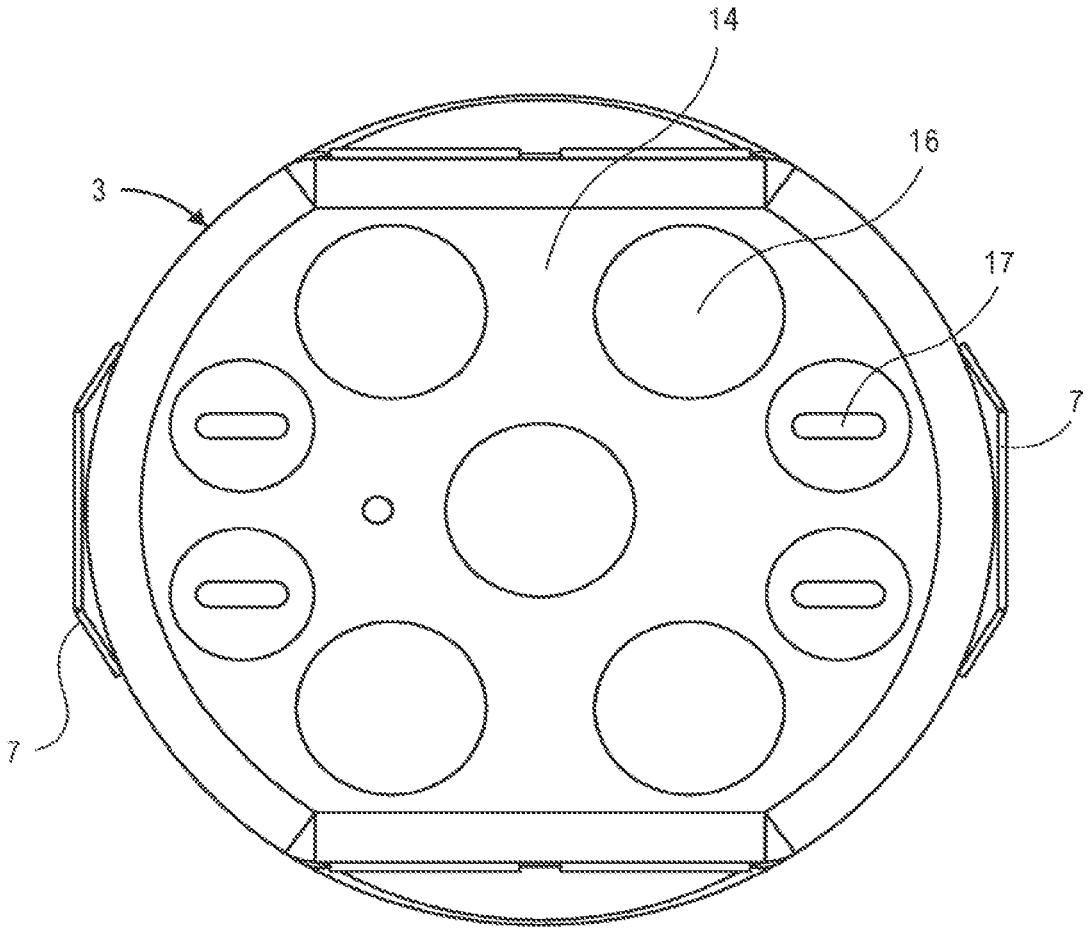
FIG. 7 shows a top view of the embodiment of FIG. 6.

As seen in FIG. 5, the outer casing 3 may have within its cavity 15 a ring 21. The ring 21 maybe shaped as a circle (shown), a polygon, or an ellipsoid, where it conforms to the sidewall 13 of outer casing 3. The ring 21 may be inserted into the cavity 15 of the outer casing 3 through the open end of the side wall 13, and then secured to the inner surface of the side wall 13 of the outer casing 3 as seen in FIG. 6. Once the ring 21 has been secured, the unified casting 4 may be inserted into the cavity 21 (through the same open end of the side wall 13) and then attached to the ring 21 so as to secure the unified casting 4 to the outer casing 3 and prevent the unified casting 4 from falling out of the outer casing. The ring 21 has one or more tabs 18 formed as a flat segment of the ring, each having an opening 19 that passes through the ring 21 (from one face to the other face)—see FIG. 4 and FIG. 6. These are used for coupling (fastening) the outer casing 3 to the unified casting 4—see FIG. 1. In the embodiment of FIG. 4, there are two tabs 18 located diametrically opposite each other (along the circumference of the ring). When the ring 21 is fitted inside the casing 3 (as seen in FIG. 5), each tab 18 may extend inward from and is perpendicular to an inner surface of the side wall 13 of the outer casing 3. Each tab 18 and its opening 19 serves to receive a fastener 20, so as to firmly hold the weight of the unified casting 4 including the light source module 8 and the driver 9 contained in the unified casting 4. The fastener 20 may be a screw, bolt, pin, or the like. In other embodiments, the tabs 18 may incorporate other types of fastening mechanisms (to fasten the unified casting 4 to the outer casing 3), such as a twist-and-lock friction connection that does not require the use of separate tools or other devices. The ring 21 should be affixed inside the cavity so that its tabs 18 may be further recessed inside the cavity 15, towards the base end 14, so that the unified casting 4 and trim 5 may also be further recessed inside the outer casing 3.

In another embodiment, the tab 18 is formed as a portion of the sidewall 13 that has bee bent inward, without the need for a ring 21. In this embodiment, the ring 21 is not necessary, as long as the unified casting 4 can otherwise be secured to the outer casing 3 via the table 18, so as to be prevented from falling out of the outer casing 3.

Figure 8:
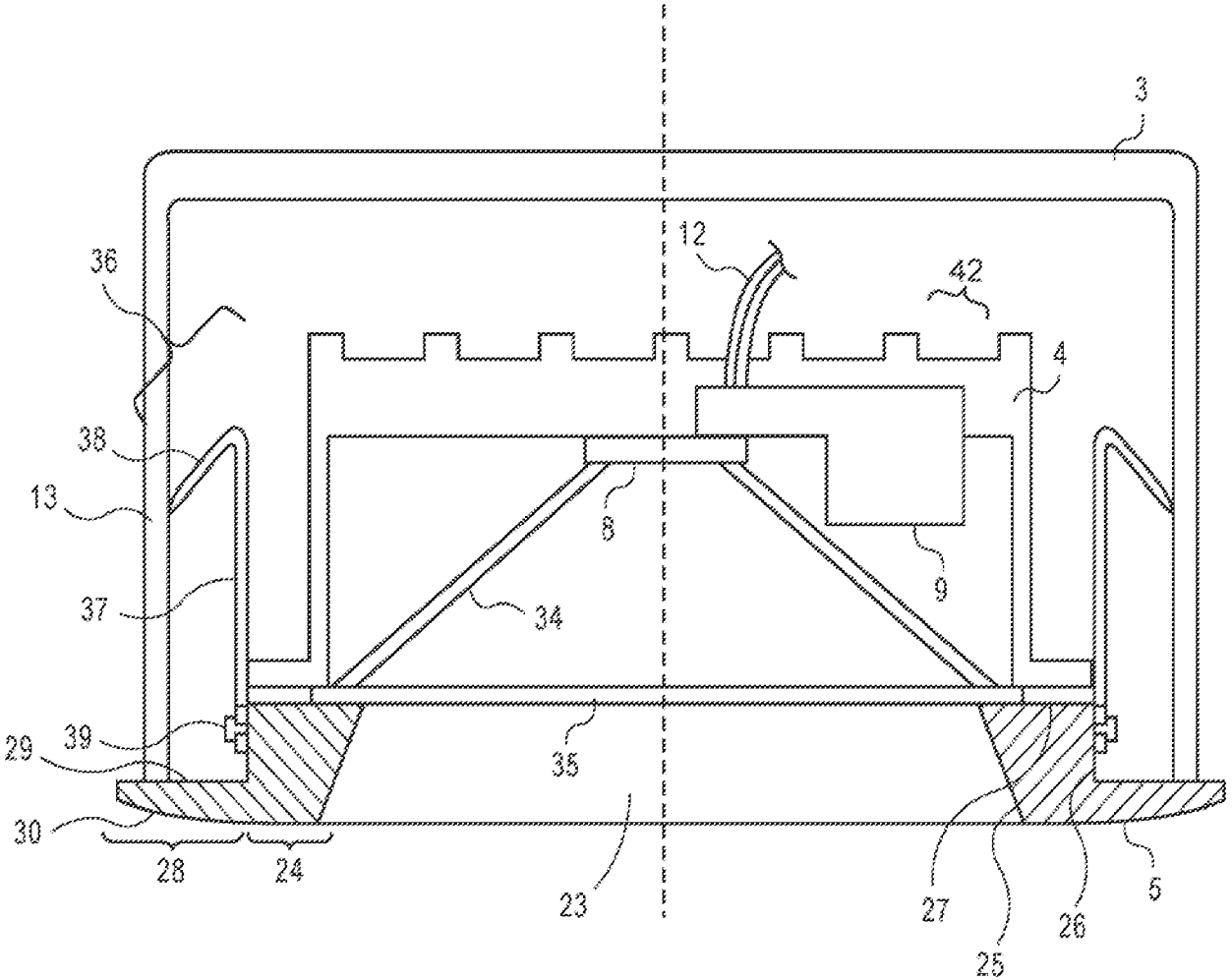
FIG. 8 shows a side cross section view of an outer casing, unified casting, trim, and two friction clips according to one embodiment.

In other embodiments, as shown in FIG. 8, the unified casting 4 may be held inside the outer casing 3, without being directly fastened to any tabs 18. Friction clips 36 (or tension clips) may be utilized to retain the unified casting 4 inside the outer casing 3. Each friction clip 36 may be attached via a screw 39 (or other fastening mechanism such as a bolt, resin, glue, or the like) to a trim base 24 of the trim 5, or directly to the unified casting 4. The friction clip 36 may be flexible and resilient. The friction clip 36 may be a piece of metal that has a straight portion 37 extending from the screw 39 and is then bent backward to form a bent portion 38. The bent portion 38 of the friction clip 36 may directly contact the inner surface of the side wall 13 of the outer casing 3, as shown, preventing the unified casting 4 and the trim 5 from falling out of the outer casing 3.

The unified casting 4 is a shell and/or enclosure that further prevents the exposure of heat from the light source module 8 and the driver 9 to the items inside a ceiling or crawl space (e.g., insulation) in which the recessed lighting fixture 1 has been installed. The unified casting 4 may be formed of metals, polymers, metal alloys, and/or other heat insulating materials. As shown in FIG. 1, the unified casting 4 may be a cylindrical structure; however, in other embodiments, the unified casting 4 may be any suitable shape, including an ellipsoid, cone, or polyhedron that is capable of housing the light source module 8 and the driver 9.

In one embodiment, the unified casting 4 includes one or more heat sinks to dissipate heat generated by the light source module 8 and/or the driver 9. Although the heat sinks are shown as fins (in FIG. 2 and FIG. 8) which are passive components (formed on the outer surface of the end wall and/or the side wall of the unified casting 4) that cool the combined unified casting 4, light source module 8, and driver 9, by dissipating heat into the surrounding air, active heat sinks (e.g., fans) may also be used. In one embodiment, the heat sinks are defined by a set of fins surrounding the unified casting 4, which are formed in the same casting (manufacturing) process that results in the unified casting 4 being formed. The heat sinks may be composed of any thermally conductive material. For example, the heat sinks may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

Still referring to FIG. 8, the recessed lighting fixture 1 may include the driver 9 contained within the unified casting 4. The driver 9 is an electronic circuit or device that supplies and/or regulates electrical energy to the light source module 8 and thus powers the light source module 8 to emit light. The light source module 8 and the driver 9 may be coupled to the end wall of the unified casting 4 as shown in FIG. 8, using any suitable connecting mechanism, including screws, resins, clips, or clamps. The driver 9 may be any type of electrical power supply, including power supplies that deliver an alternating current (AC) or a direct current (DC) voltage to the light source module 8. Upon receiving electricity through the wires 12, the driver 9 may regulate current or voltage to supply a stable voltage or current within the operating parameters of the light source module 8. The driver 9 receives an input current from the power source 10 and may drop the voltage of the input current to an acceptable level for the light source module 8 (e.g., from 120V-277V to 36V-48V). The driver 9 may transfer electrical power to the light source module 8 through an electrical connector (not shown). For example, the driver 9 may deliver electricity to the light source module 8 through an electrical cable (not shown) coupled between the light source module 8 and the driver 9 through removable or permanent connectors or soldered leads originating from the driver 9. The driver 8 may include a magnetic transformer or additional or alternative circuitry for voltage conversion and for regulating the input current or voltage to the light source module 8.

The light source module 8 may be any electro-optical device or combination of devices for emitting light. For example, the light source module 8 may have a single type of light emitting element, as a light emitting diode (LED), organic light-emitting diode (OLED), or polymer light-emitting diode (PLED). In some embodiments, the light source module 8 may have multiple light emitting elements (e.g., LEDs, OLEDs, and/or PLEDs). The light source module 8 receives electricity from the driver 9, as described above, such that the light source module 8 may emit a controlled beam of light into a room or surrounding area. The driver 9 is designed to ensure that the appropriate voltage and current are fed to the light source module 8 to enable the emission of light by the one or more light sources within the light source module 8.

In some embodiments, the recessed lighting fixture 1 may include a reflector 34 contained in the unified casting 4, as shown in FIG. 8. The reflector 34 may surround the entire light source module 8 as shown, or it may surround just a light emitting element of the light source module 8, to adjust the way light emitted by the light source module 8 is directed into a room or surrounding area. In one embodiment, the reflector 34 surrounds the entirety of the light source module 8 and also separates the light source module 8 from the driver 9. This separation allows light from the light source module 8 to be emitted into a room or surrounding area, while shielding the driver 9 from being exposed to the room or surrounding area. For example, in one embodiment, the reflector 34 and the unified casting 4 may together create a sealed structure to shield the driver 9 from the outside environment and the light source module 8. By shielding the driver 9 from the outside environment, the reflector 34 might reduce the risk of fire or other dangers and may help ensure the recessed lighting fixture 1 complies with building and safety codes/regulations. The reflector 34 may be formed of any fire retardant material, including steel, aluminum, metal alloys, calcium silicate, and other similar materials.

The reflector 34 may be formed in any shape that may direct and/or focus light. For example, the reflector 34 may be parabolic or spherical. In one embodiment, the front surface of the reflector 34 may be coated with a reflecting material or include one or more reflecting elements that assists in the adjustment of light emitted by the light source module 8. For example, the reflector 34 may be coated with a shiny enamel or include one or more mirrors or retroreflectors or a microcellular polyethylene terephthalate (MC-PET) material to adjust the focus of light emitted by the light module 8. In other embodiments, the reflector 34 may include various other optic elements to assist in the focusing of light emitted by the light source module 8.

Still referring to FIG. 8, in one embodiment, the recessed lighting fixture 1 may include a lens 35. The lens 35 may be formed to converge or diverge light emitted by the light source module 8. The lens 35 may be a simple lens 35 comprised of a single optical element or a compound lens 35 comprised of an array of simple lenses 35 (elements) with a common axis. In one embodiment, the lens 35 also provides a protective barrier for the light source module 8 and shields the light source module 8 from moisture or inclement weather. The lens 35 may also assist in the diffusion of light and increase the uniformity of light over the surface of the recessed lighting fixture 1. The lens 35 may be made of any at least partially transparent material, including glass and hard plastics. In one embodiment, the lens 35 and the reflector 34 are contained in a single indivisible unit of the unified casting 4, to work in conjunction to focus and adjust light emitted by the light source module 8. In one embodiment, the reflector and the lens are housed together with the driver and the light source module in the unified casting 4 as a single, indivisible unit. In other embodiments, the lens 35 and the reflector 34 may be separate, divisible elements.

Still referring to FIG. 8, in one embodiment, the recessed lighting fixture 1 may include a trim 5. The trim 5 may be attached directly to the unified casting 4 as well as to the outer casing 3 as shown, while in other embodiments the trim 5 is to only be attached to the outer casing 3 (where in that case the unified casting 4 is separately attached to the casing 3, as in FIG. 1 for example). The trim 5 may be attached to the unified casting 4 and/or the outer casing 3 using any suitable connecting mechanism, including resins, clips, screws, bolts, or clamps. In one embodiment, the trim 5 may include grooves and/or slots that are designed to engage with corresponding bumps or tabs of the unified casting 4 and/or the outer casing 3 to form a rotate and lock (or friction lock) connection which prevents axial separation (in FIG. 8, in the vertical or longitudinal direction) of the trim 5 and the outer casing 4, and without the use of separate tools or other devices.

Figure 2:
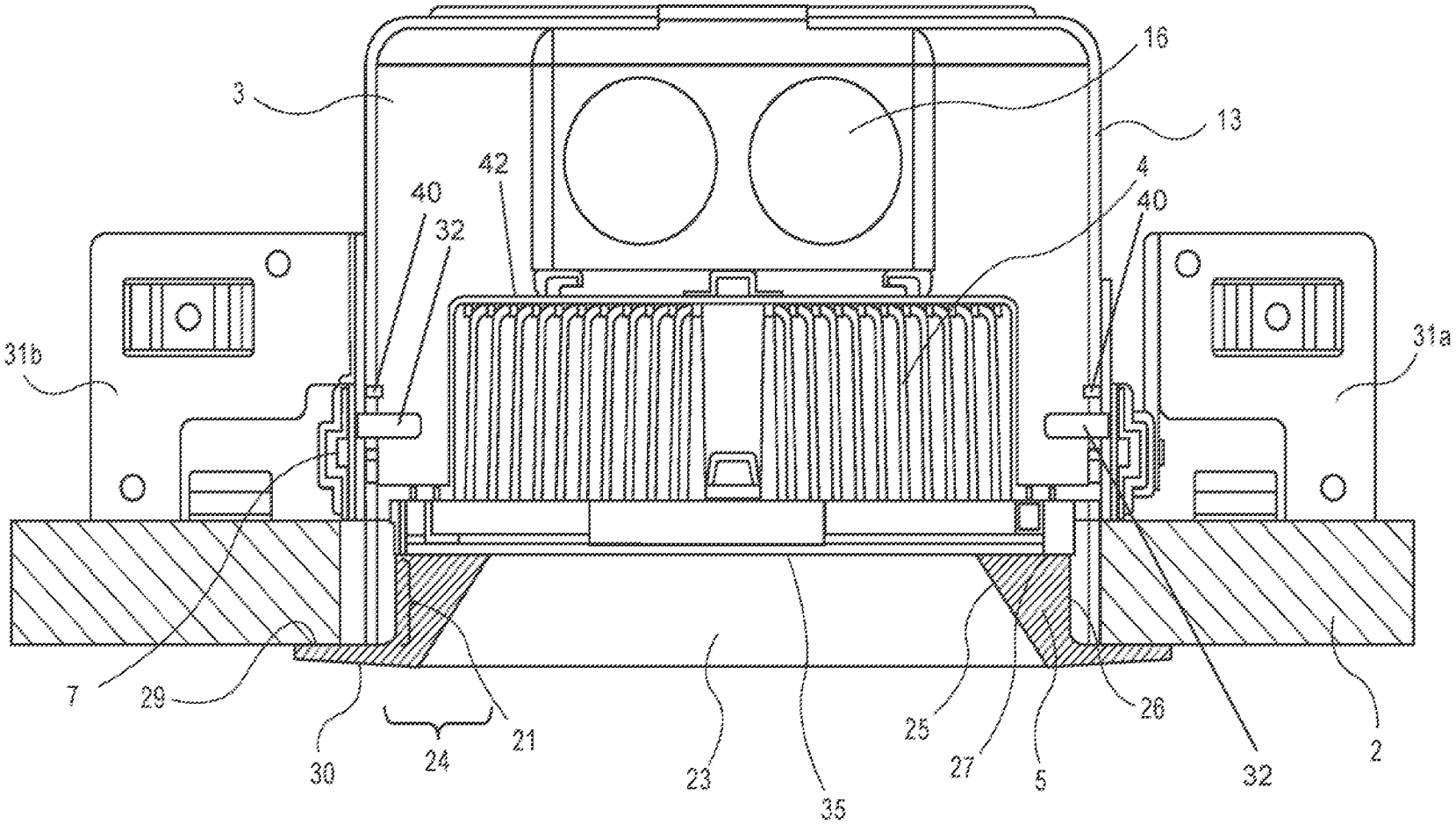
FIG. 2 shows a side cross-section view of the embodiment of FIG. 1.
Figure 3:
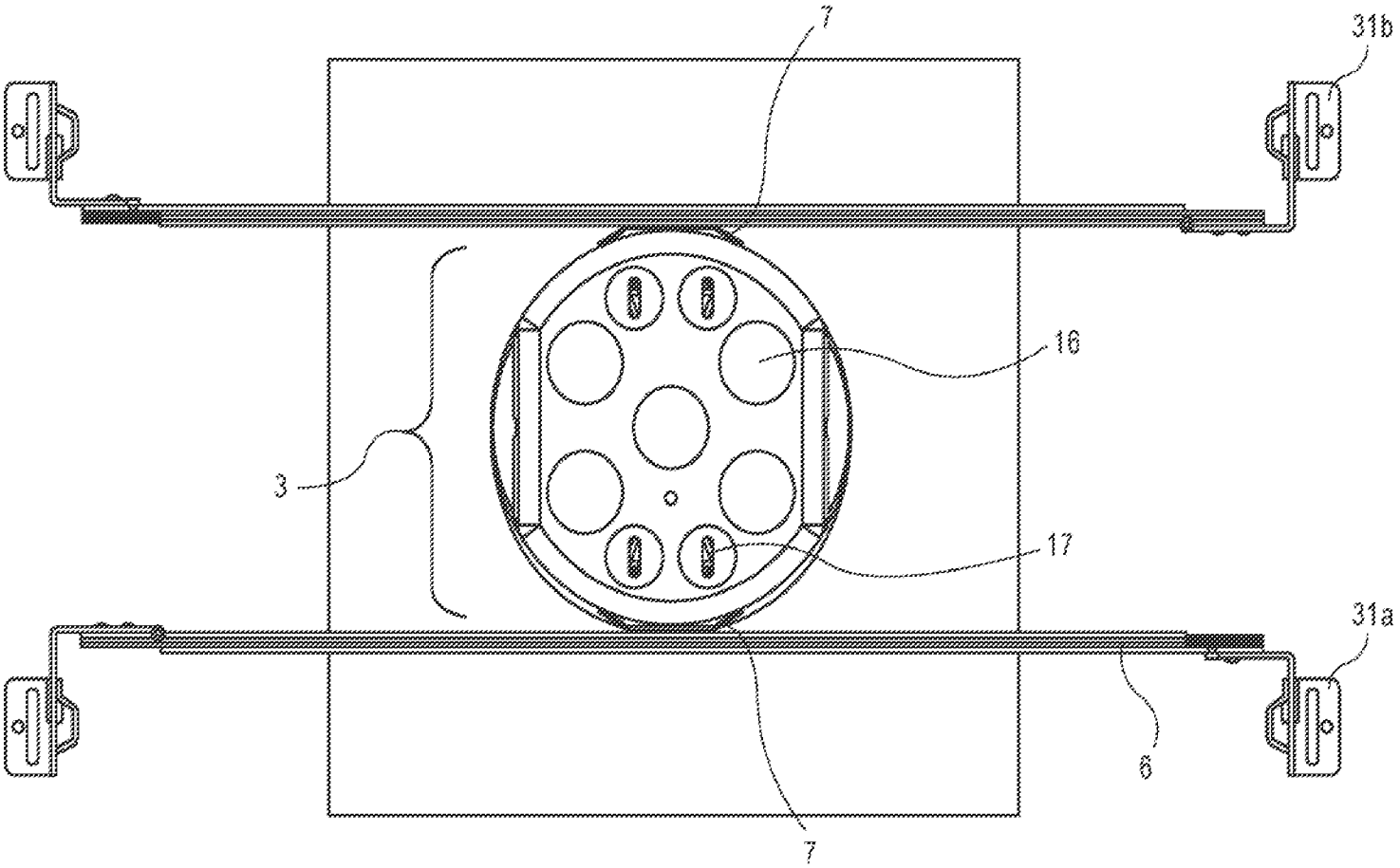
FIG. 3 shows a top view of the embodiment of FIG. 1.

In one embodiment, the entire height 21 of the trim 5, which may or may not be attached to the casting 4, may be inserted into the cavity 15 of the outer casing 3. This is where the unified casting 4 is positioned further (deeper) into the outer casing 3 so that glare from the emitted light is reduced. As seen in FIG. 1 and FIG. 2, for example, the trim 5 may have a trim base 24 (an annular segment) having a height 21, with an inner circumferential surface 25 that is open to the central, light passing aperture 23 and an outer circumferential surface 26 that is closer to the side wall 13 of the outer casing 3. The trim base 24 may have a top surface 27 that extends, in a lateral or horizontal direction, from the inner surface 25 to the outer surface 26 and may be in contact with the lower most surface of the unified casing 4. The height 21 of the trim base 24 may be increased so as to position the lens 35 further into the outer casing 3. It is preferred that the height 21 of the trim base 24 is less than. The trim 5 may have a flange 28 that extends laterally outward from the base 24, with a top surface 29 and a bottom surface 30 as shown. In one embodiment, referring now back to FIG. 1, the trim base 24 may be shaped and sized such that the outer surface 26 thereof conforms to an inner surface of the side wall 13 of the outer casing 3 so that the trim 5 and the outer casing 3 are in direct contact. In one embodiment, the trim 5 may be fitted tightly to the side wall 13 of the outer casing 3 (friction fit) so that the trim 5 does not fall out of the outer casing 3 (when the trim 5 is not also separately attached to the unified casting 4). In another embodiment, the outer surface 26 of the trim base 24 of the trim 5 may be attached to the inner surface of the side wall 13 of the outer casing 3 through any connecting mechanism. The trim 5 may be pushed into the outer casing 3 so that the bottom end or edge of the side wall 13 of the outer casing 3 comes into direct contact with the top surface 29 of the flange 28 of the trim 5, for a tight, snug fit as shown in FIGS. 1 and 2. However, it is not necessary for the end of the side wall 13 of the outer casing 3 to directly contact the top surface 29 of the flange 28 of the trim 5. In yet another embodiment, the outer surface 26 of the trim base 24 need not contact the inner surface of the side wall 13 of the outer casing 3 (e.g., when friction clips 36 are used as shown in FIG. 8).

In one embodiment, different diameter trims 5 may be capable of being coupled to the same unified casting 4 and/or the same outer casing 3, where the diameter is measured at the periphery of the flange 28. The size and design of the trims 5 may depend on the size of the hole the wall 2 in which the recessed lighting fixture 1 has been fitted to conceal the exposed wall or ceiling edge that defines the hole. The recessed lighting system 1 may include two or more trims 5 of different sizes to cover ceiling or wall openings of different sizes. The trim 5 may need to meet the aesthetic demands of the consumer. The trim 5 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

In one embodiment, the recessed lighting fixture 1 may include a set of hangar bars 6 as shown in FIG. 1. The hangar bars 6 may be rigid, elongated members that are connected to adjacent joists and/or beams in the walls or ceilings of a structure. In one embodiment, each of the hangar bars 6 may be telescoping such that each hangar bar 6 may be extended or retracted to meet the gap between the joists and/or beams. In one embodiment, each of the hangar bars 6 may include a set of mounting blocks 31. The mounting blocks 31 may be used to directly attach the hangar bars 6 to the joists and/or beams in the walls or ceilings of a structure. For example, as shown in FIG. 1, the mounting blocks 31 may include holes for receiving screws and/or nails or other fasteners that enable the hangar bars 6 to be securely attached to a building structure. Although shown in FIG. 1 and described above in relation to holes and screws, in other embodiments, other mechanisms of attachment may be used in conjunction with the mounting blocks 31, including resins, clips, or clamps to attached the bars 6 to the building structure. In one embodiment, the mounting blocks 31 may be integrated in one indivisible structure along with the hangar bars 6, while in other embodiments, as shown in FIG. 1, the mounting blocks 31 may be coupled to the hangar bars 6 through the use of one or more attachment mechanisms (e.g., screws, bolts, resins, clips, or clamps). Using the above telescoping and mounting features, the recessed lighting fixture 1 may be installed in almost all the 2"×2" through 2"×18" wood joist constructions, metal stud constructions, and t-bar ceiling constructions.

In one embodiment, referring back to FIG. 3, the recessed lighting fixture 1 may have a mounting mechanism that includes a set of hangar holders 7 (two are shown) that couple the outer casing 3 to the hangar bars 6, respectively. The hangar holder 7 may be a plate that is configured to slide substantially horizontally or otherwise move along the length of a corresponding hangar bar 6 that has a fixed length. Alternatively, the hangar holder 7 may be fixed to a telescoping section of the hangar bar (having a variable length).

FIG. 4 shows a perspective view of the hangar holder 7 according to one embodiment. The hangar holder 7 has an attachment mechanism 32 for coupling with the outer casing 3, so that the outer casing 3 can be coupled to a hangar bar 6, as seen in FIG. 6. The attachment mechanism 32 may be a pin attached to and extending inward from the inner face of the plate of hangar holder 7. The attachment mechanism 32 may be inserted into an elongated opening 33 (e.g. slot, slit, etc.) in the side wall 13 of the outer casing 3. The hangar holder 7 may also include a tab 40 located near the attachment mechanism 32 that is inserted into the opening 33. The opening 33 may be vertically or substantially vertically oriented (parallel to the direction of the wall thickness 18, or perpendicular to the longitudinal axis of the hangar bar 6—see FIG. 1) so that when the outer casing 3 is coupled to the hangar holder 7, the outer casing 3 may be moved up or down as desired (while restricted in the sideways or lateral direction due to the attachment mechanism 32 being captured within the elongated opening 33). The outer casing 3 may be moved along the length of the elongated opening 33 before being locked in a particular position. It is preferred that the elevation of the casing 3 behind the ceiling or wall 2 be adjusted in this manner so that the flange 28 of the trim 5 is flush with the ceiling or wall 2 as seen in FIG. 1.

In another embodiment, the attachment mechanism 32 may be a screw that couples the hangar holder 7 to the outer casing 3. When the screw is inserted into the opening 33 of the outer casing 3 and turned, the outer casing 3 may move up or down relative to the hangar bar 6 depending on the direction the screw is turned. Accordingly, the outer casing 3, along with the light source module 8 and the driver 9, may be moved and adjusted so that the flange 28 is flush or sufficiently close to the ceiling or wall during installation. In yet another embodiment, the location of the attachment mechanism 32 and the elongated opening 33 are reversed, so that the opening 33 is formed in the hangar holder 7 rather than in the side wall 13 of the outer casing 3, and the attachment mechanism 32 is affixed to and extending outward from the outside surface of the sidewall 13 of the casing 3.

By being moveably coupled to the hangar holders 7, the outer casing 3, along with the light source module 8 and the driver 9 therein, may be moved in a length direction of the hangar bars 6 to a desired location. The outer casing 3 may also be moved substantially vertically relative to the hangar bars 6. For example, the outer casing 3 may be adjusted vertically more than one inch upwards and one inch downwards. The hangar holders 7 may then be fixed to the hangar bars 6 so that they no longer move substantially horizontally or vertically relative to the hangar bars 6.

As described above, the combination of a hangar bar 6 and a hangar holder 7 allows the outer casing 3 to be moved in a direction parallel to a longitudinal axis of the hangar bar 6, as well as in a direction not parallel (e.g., perpendicular) to the hangar bar 6. Accordingly, the outer casing 3 may be moved to a preferred location between a set of joists or beams in a structure and at a desired height before the being locked into position using the attachment mechanism 32. The unified casting 4 is then positioned inside the outer casing 3, by being inserted into the cavity 15 through the opening defined by the lower end, edge or periphery of the side wall 13. By being configured such that the outer casing 3, along with the light source module 8 and the driver 9 therein, is coupled to a unified set of moveable elements that assist in positioning the combined structure, the recessed lighting fixture 1 eliminates the added bulk and size of traditional recessed lighting fixtures. In particular, the recessed lighting fixture 1 allows adjustment of the position of the light source module 8 between joists or beams, without the need for both a compartment or can that is dedicated to housing the light source module 8 and a separate compartment that is dedicated to housing the driver 9. Instead, the light source module 8 may be housed along with the driver 9 in the same cavity 15 of the outer casing 3, where the latter itself can be directly moved to a desired position. This compact design provides an affordable design by cutting the cost of raw materials and other components and reduces shipping costs by reducing bulk. Also, by having the driver 9 and the light source module 8 placed in the same cavity of the outer casing 3, serviceability and replacement of the driver 9 will be easier to perform and more convenient. In contrast, traditional housings have the driver 9 mounted on the outer casing 3 and contractors are forced to spend a significant amount of time removing parts to gain access to the outer casing 3 and the driver 9.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

The invention claimed is:

1. An apparatus, comprising:

an outer casing, comprising:

a closed base end;

a sidewall joined to the closed base end, the sidewall and the closed base end together defining a cavity to contain at least a lighting module, the sidewall comprising:

a portion having a substantially cylindrical shape;

a lower edge, joined to the portion having the substantially cylindrical shape and located opposite to the closed base end, defining a circular opening;

at least two diametrically opposed flat portions, joined to the portion having the substantially cylindrical shape, starting at and extending from the closed base end; and at least two sloped portions, each sloped portion of the at least two sloped portions joining a corresponding flat portion of the at least two diametrically opposed flat portions to the portion of the sidewall having the substantially cylindrical shape;

at least one knockout disposed on the closed base end; and a hangar bar assembly, comprising:

a hangar holder, coupled to the sidewall of the outer casing via an attachment mechanism; and a pair of telescopically slidable hangar bars slidably coupled to the hangar holder, each hangar bar in the pair of telescopically slidable hangar bars having a mounting block, wherein the hangar holder is translationally movable with respect to the outer casing in a direction along the sidewall between the closed base end and the lower edge.

2. The apparatus of claim 1, wherein the outer casing has an outside height, defined between the closed base end and the lower edge of the sidewall, that is greater than 2½ inches and less than 5 inches.

3. The apparatus of claim 1, wherein the apparatus maintains a fire rating of up to two hours per the National Electrical Code (NEC) and the Underwriters Laboratories (UL) 263.

4. The apparatus of claim 1, wherein:

the attachment mechanism is a pin; and the hangar holder has an elongated opening to receive the pin so as to couple the hangar bar assembly to the sidewall of the outer casing.

5. The apparatus of claim 4, wherein:

the hangar bar assembly is a first hangar bar assembly, the hangar holder is a first hangar holder, the elongated opening is a first elongated opening, the pin is a first pin, and the pair of telescopically slidable hangar bars is a first pair of telescopically slidable hangar bars; and the apparatus further comprises:
a second hangar bar assembly, comprising:
a second hangar holder, disposed diametrically opposite from the first hangar holder, having a second elongated opening to receive a second pin so as to couple the second hangar bar assembly to the sidewall of the outer casing; and
a second pair of telescopically slidable hangar bars slidably coupled to the second hangar holder, each hangar bar in the second pair of telescopically slidable hangar bars having a mounting block.

6. The apparatus of claim 1, further comprising:
the lighting module, comprising:
a housing;
a light source module coupled to the housing; and
a driver coupled to the housing.

7. The apparatus of claim 6, further comprising:
a trim coupled to the lighting module, the trim comprising:
a trim base; and
at least one friction clip, coupled to the trim base, to couple the lighting module and the trim to the outer casing.

8. The apparatus of claim 1, wherein:
the at least one knockout is at least one first knockout; and
the outer casing further comprises:
at least one second knockout disposed on at least one flat portion of the at least two diametrically opposed flat portions.

9. The apparatus of claim 8, further comprising:
electrical wires, inserted through an opening formed by the removal of one knockout from one of the at least one first knockout or the at least one second knockout, supplying 120 VAC to the apparatus.

10. An apparatus, comprising:
an outer casing, comprising:
a closed base end whose largest extension defines a base end plane;
a sidewall coupled to the closed base end and extending substantially perpendicular to the closed base end plane such that the sidewall and the base end together define a cavity, the sidewall comprising:
a first flat portion of the sidewall abutting the closed base end; and
a second flat portion of the sidewall abutting the closed base end and located diametrically opposite from the first flat portion; and
a hangar bar assembly, comprising:
a hangar holder slidably coupled to the sidewall so as to be movable with respect to the sidewall of the outer casing;
a first hangar bar slidably coupled to the hangar holder;
a second hangar bar slidably coupled to the hangar holder and telescopically slidable with respect to the first hangar bar;
a first mounting block coupled to the first hangar bar; and
a second mounting block coupled to the second hangar bar,
wherein:
at least a portion of an exterior of the sidewall has a substantially cylindrical shape;
the sidewall of the outer casing has a lower edge defining an opening into the cavity of the outer casing;
the outer casing has an outside height, defined between the closed base end and the lower edge of the sidewall, that is greater than 2½ inches and less than 5 inches;
at least one of the first flat portion and the second flat portion includes at least one knockout; and
the first mounting block and the second mounting block each include attachment features to couple to at least one of a wood joist or a t-bar.

11. The apparatus of claim 10, wherein the sidewall of the outer casing further comprises:
a first sloped portion joined to the first flat portion and the portion of the sidewall having the substantially cylindrical shape; and
a second sloped portion joined to the second flat portion and the portion of the sidewall having the substantially cylindrical shape.

12. The apparatus of claim 10, wherein the apparatus maintains a fire rating of up to two hours per the National Electrical Code (NEC) and the Underwriters Laboratories (UL) 263.

13. The apparatus of claim 10, wherein:
the hangar holder has an elongated opening; and
the hangar holder is slidably coupled to the sidewall of the outer casing via a pin inserted through the elongated opening.

14. The apparatus of claim 10, further comprising:
a lighting module disposed entirely within the cavity of the outer casing, the lighting module comprising:
a housing;
a light source module coupled to the housing; and
a driver coupled to the housing.

15. The apparatus of claim 14, wherein the housing of the lighting module does not physically contact the sidewall of the outer casing.

16. The apparatus of claim 14, further comprising:
a trim coupled to the lighting module, the trim comprising:
a trim base at least partially disposed within the cavity of the outer casing; and
at least one friction clip, coupled to the trim base, to couple the lighting module and the trim to the outer casing.

17. The apparatus of claim 16, wherein the lighting module is offset from the opening of the outer casing by a height of the trim base.

18. The apparatus of claim 10, wherein:
the at least one knockout is at least one first knockout;
the outer casing further comprises:
at least one second knockout disposed on the closed base end; and
the apparatus further comprises:
electrical wires, inserted through an opening formed by the removal of one knockout of the at least one first knockout or the at least one second knockout, to supply 120 VAC to the apparatus.

19. An apparatus, comprising:
an outer casing, comprising:
a closed base end;
a sidewall joined to the closed base end, the sidewall and the closed base end together defining a cavity, the sidewall comprising:
a cylindrical portion;
a lower edge, joined to the cylindrical portion and located opposite to the closed base end, defining a circular opening;
two diametrically opposed flat portions, joined to the cylindrical portion, starting at and extending from the closed base end; and
two sloped portions, each sloped portion of the two sloped portions joining a corresponding flat portion of the two diametrically opposed flat portions to the cylindrical portion;

at least one first knockout disposed on the closed base end; and at least one second knockout disposed on at least one flat portion of the two diametrically opposed flat portions; and a first hangar bar assembly, comprising:

a first hangar holder slidably coupled to the sidewall so as to be movable with respect to the sidewall of the outer casing;

a first hangar bar slidably coupled to the first hangar holder;

a second hangar bar slidably coupled to the first hangar holder and telescopically slidable with respect to the first hangar bar;

a first mounting block coupled to the first hangar bar; and a second mounting block coupled to the second hangar bar, wherein the outer casing has an outside height, defined between the closed base end and the lower edge of the sidewall, that is greater than 2½ inches and less than 5 inches.

20. The apparatus of claim 19, wherein:

the first hangar holder has a first elongated opening; and the first hangar holder is slidably coupled to the sidewall of the outer casing via a first pin inserted through the first elongated opening.

21. The apparatus of claim 20, further comprising:

a second hangar bar assembly, comprising:

a second hangar holder, disposed diametrically opposite from the first hangar holder, having a second elongated opening, the second hangar holder being slidably coupled to the sidewall of the outer casing via a second pin inserted through the second elongated opening;

a third hangar bar slidably coupled to the second hangar holder;

a fourth hangar bar slidably coupled to the second hangar holder and telescopically slidable with respect to the third hangar bar;

a third mounting block coupled to the third hangar bar; and a fourth mounting block coupled to the fourth hangar bar.

22. The apparatus of claim 19, further comprising:

electrical wires, inserted through an opening formed by the removal of one knockout of the at least one first knockout or the at least one second knockout, to supply 120 VAC to the apparatus.

23. The apparatus of claim 22, further comprising:

a lighting module disposed entirely within the cavity of the outer casing, the lighting module comprising:

a housing;

a light source module coupled to the housing; and a driver, coupled to the housing, to receive the 120 VAC from the electrical wires.

24. The apparatus of claim 23, wherein the housing of the lighting module does not physically contact the sidewall and the base end of the outer casing.

25. The apparatus of claim 23, further comprising:

a trim coupled to the lighting module, the trim comprising:

a trim base at least partially disposed within the cavity of the outer casing; and at least one friction clip, coupled to the trim base, to couple the lighting module and the trim to the outer casing.

26. An apparatus, comprising:

an outer casing, comprising:

a closed base end whose largest extension defines a base end plane;

a sidewall coupled to the closed base end and extending perpendicular to the closed base end plane such that the sidewall and the closed base end together define a cavity, the sidewall comprising:

an upper end joined to the closed base end;

a lower end defining a circular opening;

a cylindrical portion joined to the lower end and a portion of the upper end;

two diametrically opposed flat portions, joined to the cylindrical portion, starting at and extending from the upper end; and two sloped portions, each sloped portion of the two sloped portions joining a corresponding flat portion of the two diametrically opposed flat portions to the cylindrical portion;

a first knockout disposed on a first flat portion of the two diametrically opposed flat portions;

a second knockout disposed on a second flat portion of the two diametrically opposed flat portions;

a third knockout disposed on the closed base end;

a fourth knockout disposed on the closed base end;

a fifth knockout disposed on the closed base end; and a sixth knockout disposed on the closed base end;

a first hangar bar assembly, comprising:

a first hangar holder slidably coupled to the cylindrical portion of the sidewall so as to be movable with respect to the sidewall;

a first hangar bar slidably coupled to the first hangar holder;

a second hangar bar slidably coupled to the first hangar holder and telescopically slidable with the first hangar bar;

a first mounting block coupled to the first hangar bar; and a second mounting block coupled to the second hangar bar; and a second hangar bar assembly, comprising:

a second hangar holder slidably coupled to the cylindrical portion of the sidewall so as to be movable with respect to the sidewall independent of the first hangar holder, the second hangar holder being disposed diametrically opposite from the first hangar holder;

a third hangar bar slidably coupled to the second hangar holder;

a fourth hangar bar slidably coupled to the second hangar holder and telescopically slidable with the third hangar bar;

a third mounting block coupled to the third hangar bar; and a fourth mounting block coupled to the fourth hangar bar, wherein:

the outer casing has an outside height greater than 2½ inches and less than 5 inches; and each of the first, second, third, and fourth mounting blocks include attachment features to couple to at least one of a wood joist, metal stud, or a t-bar.

27. The apparatus of claim 26, wherein the apparatus maintains a fire rating of up to two hours.

28. The apparatus of claim 26, further comprising:

electrical wires, inserted through an opening formed by the removal of one knockout of the at least one first knockout or the at least one second knockout, to supply 120 VAC to the apparatus.

29. The apparatus of claim 28, further comprising:

a lighting module disposed entirely within the cavity of the outer casing, the lighting module comprising:

a housing;

a light source module coupled to the housing; and a driver, coupled to the housing, to receive the 120 VAC from the electrical wires.

30. The apparatus of claim 29, further comprising:

a trim coupled to the lighting module, the trim comprising:

a trim base at least partially disposed within the cavity of the outer casing; and at least one friction clip, coupled to the trim base, to couple the lighting module and the trim to the outer casing.

* * * * *